US006098344A

United States Patent [19]

Albracht

[11] Patent Number: 6,098,344

[45] **Date of Patent: *Aug. 8, 2000**

[54] GUTTER PROTECTION SYSTEM AND INSTALLATION THEREOF

[76] Inventor: Gregory P. Albracht, 9623 Burdette, Omaha, Nebr. 68134

[ * ] Notice: This patent is subject to a terminal disclaimer.

[21] Appl. No.: 08/911,520

[22] Filed: Aug. 14, 1997

Related U.S. Application Data

[63] Continuation of application No. 08/688,404, Jul. 30, 1996, Pat. No. 5,660,001, and a continuation of application No. 08/414,271, Mar. 31, 1995, Pat. No. 5,557,891.

[60] Provisional application No. 60/002,017, Aug. 8, 1995, and provisional application No. 60/030,780, Nov. 13, 1996.

[51] Int. Cl.[7] ..... E04D 13/076

[52] U.S. Cl. ..... 52/12; 52/712; 52/747.1; 52/748.1

[58] Field of Search ..... 52/11, 12, 712, 52/747.1, 748.1

[56] References Cited

U.S. PATENT DOCUMENTS

| | | |
|---|---|---|
| 603,611 | 5/1898 | Nye . |
| 2,847,949 | 4/1958 | Pond . |
| 2,873,700 | 2/1959 | Heier . |
| 3,436,878 | 4/1969 | Singer . |
| 4,036,761 | 7/1977 | Rankin . |
| 4,286,418 | 9/1981 | Snyder . |
| 4,404,775 | 9/1983 | Demartini . |
| 4,455,791 | 6/1984 | Elko et al. . |
| 4,493,588 | 1/1985 | Duffy . |
| 4,497,146 | 2/1985 | Demartini . |
| 4,551,956 | 11/1985 | Axford . |
| 4,571,896 | 2/1986 | Condie . |
| 4,592,174 | 6/1986 | Hileman . |
| 4,631,875 | 12/1986 | Olson . |
| 4,745,710 | 5/1988 | Davis . |
| 4,750,300 | 6/1988 | Winger, Jr. . |
| 4,757,649 | 7/1988 | Vahldieck . |
| 4,796,390 | 1/1989 | Demartini . |
| 4,858,396 | 8/1989 | Rose et al. . |
| 4,866,890 | 9/1989 | Otto . |
| 4,876,827 | 10/1989 | Williams . |
| 4,937,986 | 7/1990 | Way, Sr. . |
| 5,016,404 | 5/1991 | Briggs . |
| 5,181,350 | 1/1993 | Meckstroth . |
| 5,189,849 | 3/1993 | Collins . |
| 5,216,851 | 6/1993 | Kuhns . |
| 5,660,001 | 8/1997 | Albracht ..... 52/12 |

*Primary Examiner*—Christopher T. Kent
*Attorney, Agent, or Firm*—Zarley, McKee, Thomte, Voorhees & Sease; James A. Napier

[57] ABSTRACT

Disclosed is a gutter protection system (GPS) which serves to effect at least two water flow slowing direction reversals in use, and directs rain water into gutter systems (GS) that collect rain water at the lower edges of sloping building roofs, while preventing the accumulation of debris therein. In particular, mounting clip design (MCK) (MCR) (MCV) in combination with gutter protection system (GPS) design, featuring limited mounting clip (MCK) (MCR) (MCV) three-dimensional motion allowing, installation facilitating, hem section (HS) (HS') and projecting lip (C) (PLK') (PLR') (PLV') interconnection, are described.

21 Claims, 8 Drawing Sheets

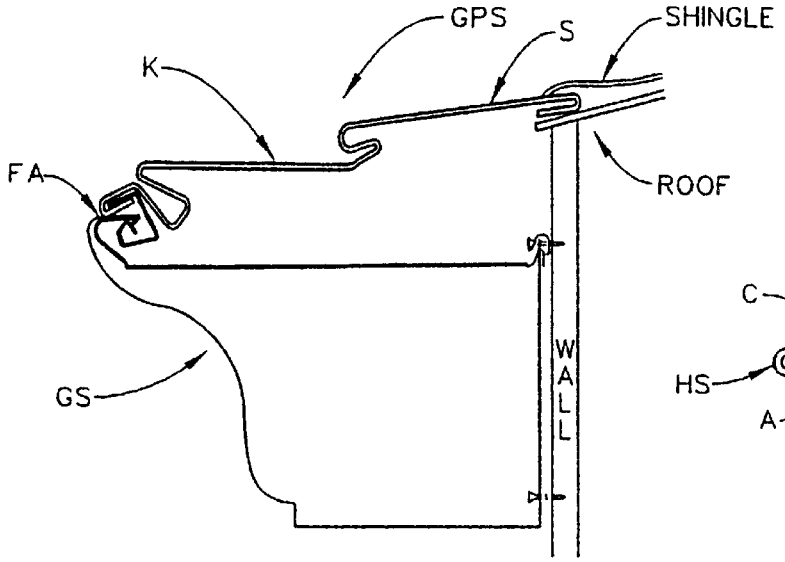
FIG. 1
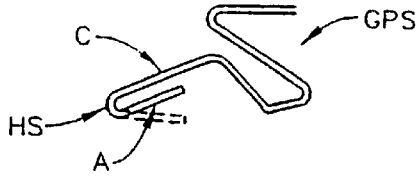
FIG. 2a
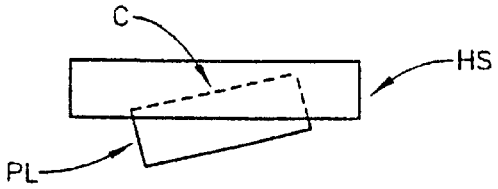
FIG. 7a
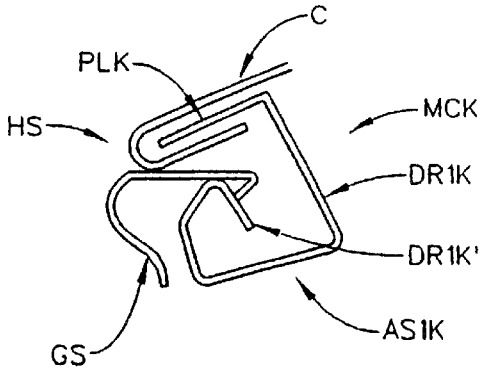
FIG. 2b1
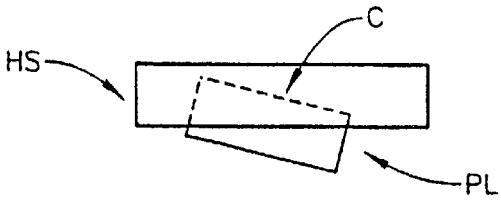
FIG. 7b

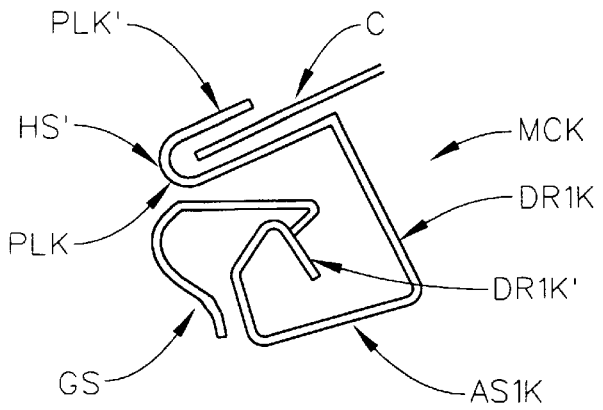
FIG. 2b2
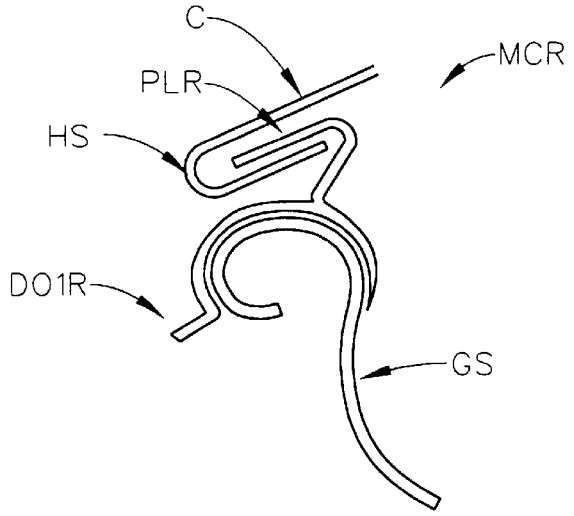
FIG. 2b3
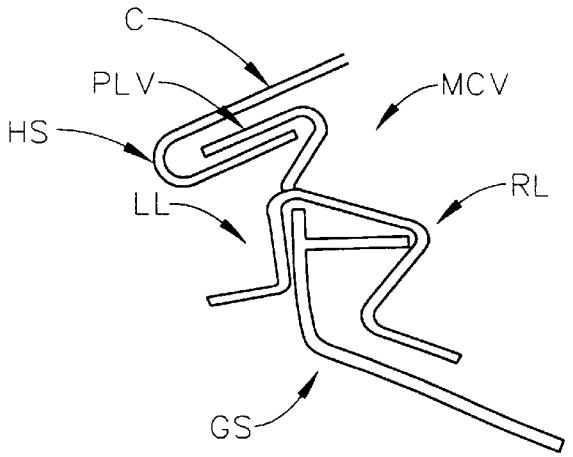
FIG. 2b4

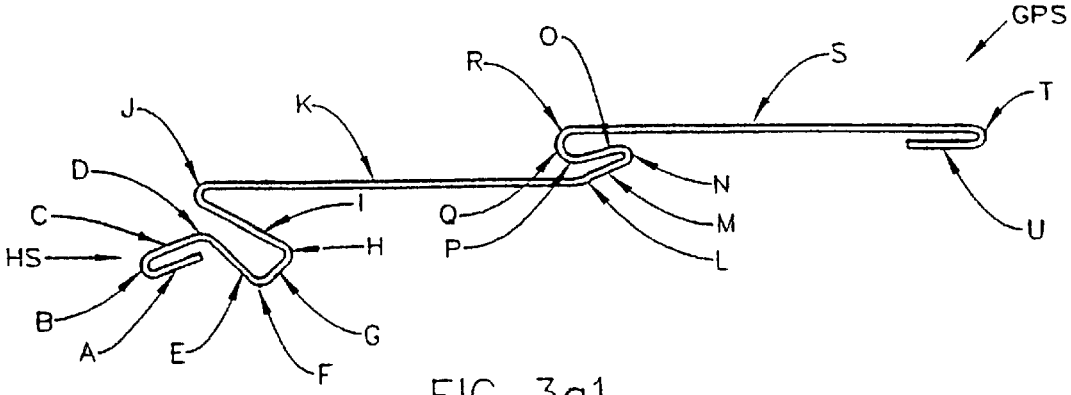
FIG. 3a1
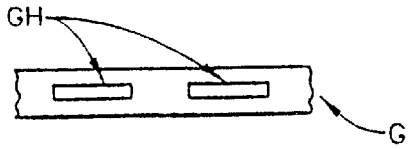
FIG. 3b1
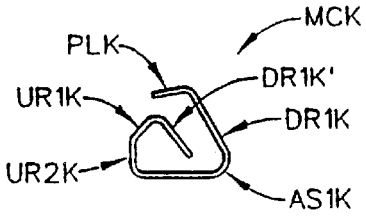
FIG. 4a
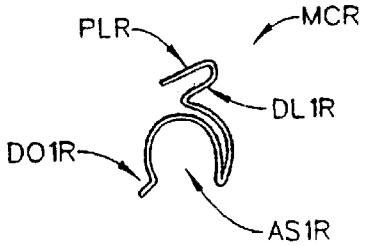
FIG. 5a
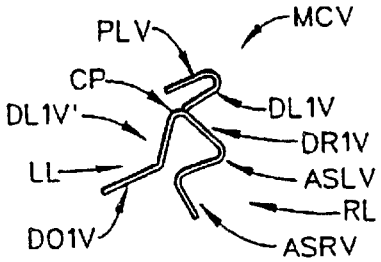
FIG. 6a

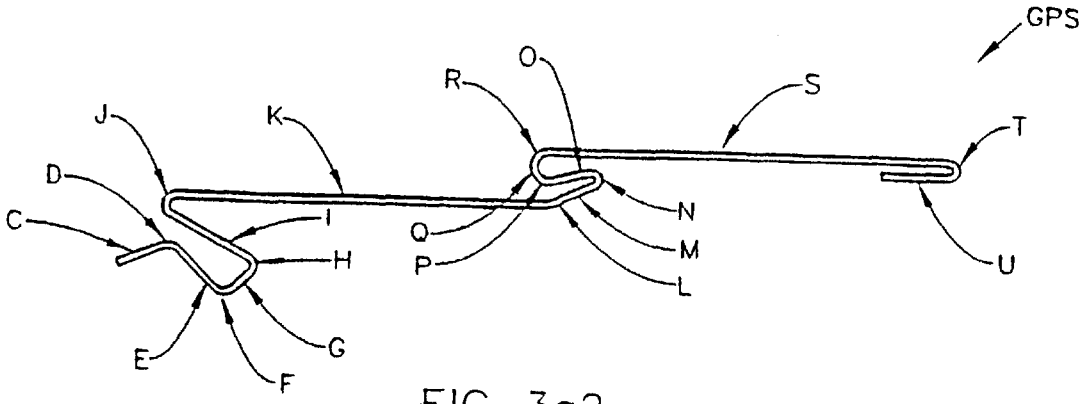
FIG. 3a2
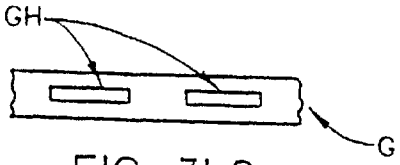
FIG. 3b2
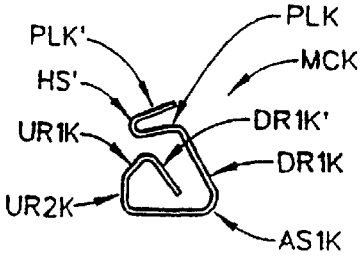
FIG. 4b
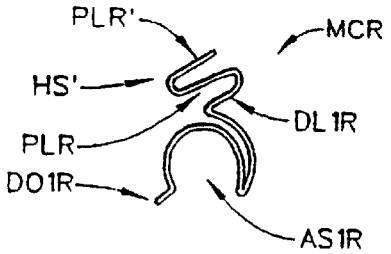
FIG. 5b
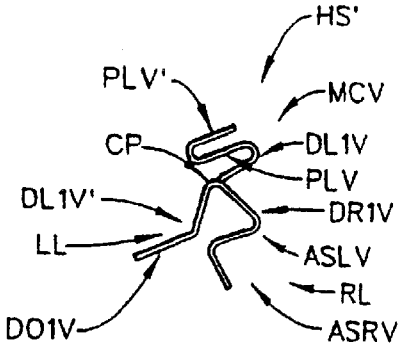
FIG. 6b

GUTTER PROTECTION SYSTEM AND INSTALLATION THEREOF

Priority for this Application is a continuation of Utility patent application Ser. No. 08/688,404 filed Jul. 30, 1996, now U.S. Pat. No. 5,660,001, and Ser. No. 08/414,271, filed Mar. 31, 1995, now U.S. Pat. No. 5,557,891, and claims priority from U.S. Provisional Patent Application Ser. No. 60/030,780 filed Nov. 13, 1996, and from 60/002,017, filed Aug. 8, 1995.

TECHNICAL FIELD

The present invention relates to gutter systems which collect rain water at the lower edges of sloping building roofs, and to gutter protection systems which prevent the accumulation of debris in gutter systems during use, while allowing water to enter thereinto. More particularly the present invention relates to gutter protection system design in combination with mounting clip designs, featuring hem and projecting lip interconnection, which simplifies installation of gutter protection systems on K-style, Half-Round and Vinyl gutter systems.

BACKGROUND

The use of gutter systems at the lower edges of sloping building roofs to accumulate and direct rain water running-off thereof into downspouts for disposal at intended locations, is known. A problem associated with typical gutter systems during use thereof, however, is that they accumulate debris therein, such as leaves and twigs etc., and become clogged. This can occur as typical gutter systems are open as viewed from the top. Clogged gutter systems can overflow, and in addition to the nuisance created by the failure of said clogged gutter systems to direct water to intended downspouts for disposal at an intended location, can cause water to come into contact fascia and soffits etc. of the buildings to which they are applied. Constant contact with said water can cause damage to said fascia and soffits etc. In severe cases, such as during freezing weather, clogged gutters can develop ice damns, leading to the presence of sufficient weight in said gutter systems so as to actually dislodge them from said associated building. In even minor cases of clogging users must face the inconvenience of having to clean accumulated debris from the said gutter systems.

Inventors have noted the identified problem and responded with numerous systems which, to lesser or greater degrees, serve to overcome the identified problems. A very early, (1898), U.S. Pat. No. 603,611 to Nye, for instance describes, in the language of Nye, "an eves hanging trough having its inner wall carried upward above said trough, thence outward over said trough, and backward to the line of attachment to the roof, all in gentle curves . . . ". The Nye system operates by, via capillary action, directing water which runs off the roof of a building to which it is attached onto the portion of the inner wall thereof which is carried outward over the trough thereof and then into said trough, while simultaneously sweeping leaves and other debris off the system, and thereby preventing them from entering said trough. The Nye system is best visualized as comprising a backward "S" shape in side cross section, the upper edge of which is mounted to the eves of a building to which said Nye system is affixed. Another and more recent (1985) U.S. Pat. No. 4,493,588 to Duffy, describes a system essentially similar to the Nye system, in which "[T]the curved portion overhangs the trough and a generally vertical screen extends between the trough and the curved portion . . . ". That is, a screen is present to further prevent leaves, twigs and other debris from entering the trough thereof. The upper edge of the Duffy system mounts under shingles on a roof of a building to which said system is affixed. Another more recent (1988) variation of a gutter system which provides benefits similar to those provided by the Nye invention is described in U.S. Pat. No. 4,757,649 to Vahldieck. The Vahldieck invention system comprises "a continuous double-curved convolute curve, generated on a first and second radius, which extends from the back wall, down short of the inside wall of the trough, and inward over the trough". The Vahldieck system is best visualized as being essentially of a squared "IC" shape in side cross section, with the edge of the lower extent of said squared "C" shape being bent upward to form said trough, and with the with the upper extent of said squared "IC" shape being curved downward in two stages, the second stage of which is defined by a tighter radius of curvature than in the first. In use, water running-off a roof of a building to which the Vahldieck system has been affixed follows, by capillary action, the double curved upper extent of said squared "C" shape and falls into the formed trough. Again, leaves and other debris are directed to locations other than into said trough. A 1989 Rose et al. U.S. Pat. No 4,858,396 provides yet another variation on the same general theme "wherein a substantially flat extension which passes beneath the eves terminates in a free edge adjacent a narrow slot in an apex portion of an extended synthetic polymeric tube".

The Patents surveyed to this point serve to provide systems which are particularly applicable to new construction. That is, the Nye, Duffy, Vahldieck and Rose et al. systems provide gutters as a part thereof. Said systems are also applicable as replacements for existing gutter systems, but, said systems are not particularly relevant for retro-fit application to existing gutter systems. Inventors have however, during the 1980's and on into the 1990's, also provided numerous systems applicable for retro-fit to existing gutter systems. For instance, U.S. Pat. Nos. 4,404,775, 4,497,146 and 4,796,390 to Demartini describe systems ". . . which comprise a deflector having a sloped portion, the top edge region of which is adapted for juxtaposition to the roof shingles, and the bottom edge region of which is arcuate through a large radius cross-section. In such embodiments, the farthest outward extension is outside the outermost edge of the associated rain gutter and the lower edge is positioned between the edges of the rain gutter. Embodiments include means for attenuating the force of water and reducing the localized concentrating of water flowing thereover, such as longitudinal ridges and/or means for improving the surface wettability". The system can be visualized as essentially being "hook-shaped", (in side cross-section), in which, during use, the tip of the "hook" is oriented so as to face downward between the edges of an associated gutter system, and the shaft of said "hook" is positioned beneath shingles on the lower edge of the roof of a building to which the system is applied. Importantly, the Demartini Patents also describe numerous mounting means for use in mounting the described system to existing gutter systems. Another U.S. Pat. No. 4,455,791 to Elko et al., provides another system for similar use in retro-fit to existing gutter systems. "A protective structure for a gutter includes an elongated, impervious sheet wide enough to extend across at least about 90% of the width of the gutter and up under a lower edge of roofing material. The outer edge of the cover curls downwardly and the water follows the curvature by surface tension to cascade into the gutter. The cover may be held in place by straps that extend transversley across it and have one end engaged under the inwardly turned lip of the gutter and the other end engaged under roofing material". Alternatively clips can also be used for mounting the cover. Another Patent which describes a system for use in retro-fit to existing gutter systems is U.S. Pat. No. 5,016,404 to Briggs. This system provides that "[A] a sheet layer has an edge beneath the shingles and curves in front of and below the fascia above the gutter mouth forming a relatively small entrance region with the gutter. The apex of the curve extends beyond the gutter so that debris carried by water run off falls to the ground while the run off flows around the layer into the gutter". U.S. Pat. No. 5,189,849 to Collins describes a two piece roof rain gutter debris shield/run-off water control system. In the words of Collins, " . . . a roof slope adaptor and its alternate means accommodate every and all roof slope/gutter juxtaposition, thereby eliminating traditional installation problems, a support stabilizer functions to provide stability and rigidity, while preserving the integrity of critical embodiment dimensions, a slope adaptor affixation clip means provides a plurality of attachment means". In essence, a gutter shield embodiment is attached to and above a gutter by means of a support stabilizer, and provides a horizontally oriented capillary cap portion at an upper aspect thereof. A roof slope adaptor provides continuity between the roof of a building to which the system is affixed and said horizontally oriented capillary cap portion. The upper edge of said roof slope adaptor is placed under shingles at the lower edge of said roof and the lower edge thereof rests atop said horizontally oriented capillary cap portion.

Additional Patents describe the use of slots or openings in gutter shield systems. For instance a Otto, U.S. Pat. No. 4,866,890 describes "[A] a cover member for mounting on a conventional rain gutter on a building structure, consisting of a one piece thin, longitudinal shield to be inserted under the shingles of the roof and having a serrated outer edge which is bent downward a short distance back from its edge so that it can rest on the flat portion of the inner wall at the top lip of the gutter, the serrations providing small openings which water from the roof can run into the gutter and exclude pine straw or leaves from entering the gutter". Another U.S. Pat. No. 4,876,827 to Williams describes that "[T] the gutter assembly includes a curved water shed surface with a plurality of openings along its vertical portion which selectively allow the water to enter the gutter positioned below while excluding pine needles, leaves and other debris from engaging the gutter". U.S. Pat. No. 5,181,350 to Meckstroth describes that "[A] an elongated strip of extruded plastics material includes a generally flat longitudinally extending inner portion adapted to project under the shingles of a roof and a longitudinally extending outer portion adapted to seat on the outer edge portion of a rain gutter and project outwardly from the gutter to form a drip lip spaced from the gutter. A longitudinally extending intermediate portion of the strip integrally connects the inner portion to the outer portion and has a rounded nose surface above a U-shaped channel for directing water from the inner portion into the gutter and for deflecting leaves and other debris onto the outer portion of the strip for dropping them from the drip lip". U.S. Pat. No. 4,571,896 to Condie describes that "[A] a gutter assembly is provided which comprises an elongated, preferably transversely flexible sheet which when in an installed position extends along a building roof adjacent an edge of it, while extending below the roof edge. A pipe is provided which has a lengthwise extending slot which accommodates a side edge of the sheet through it adjacent an edge of the slot, while leaving room for entry of only water through the slot". "Such a gutter assembly inhibits entry of foreign matter into the pipe". A similar pipe arrangement is described in U.S. Pat. No. 4,551,956 to Axford. A Kuhns, U.S. Pat. No. 5,216,851 describes a system with an extended flat portion which does not contain any apertures and serves to close the open top of a gutter to which it is applied. The extended flat portion is connected to an apertured portion, which apertured portion connects to the upper lip of the front wall of a gutter via a lip portion thereof. Said apertures are shaped to direct water into the associated gutter while causing debris to simply flow over the outer front wall of the gutter. An Olsen, U.S. Pat. No. 4,631,875 describes a system with a generally planar surface which has a plurality of spaced parallel apertures which allow the entry of water into an underlying gutter. Way Sr. et al, U.S. Pat. No. 4,937,986 and Pond, U.S. Pat. No. 2,847,949 describe gutter protection systems which provide an element which projects at a slope opposite to that of a roof to which the gutter they protect is attached, so that water exiting thereonto is slowed thereby. Both provide perforations in the oppositely sloped element so that water can enter to an underlying gutter.

A previous Patent to present Applicant Albracht, U.S. Pat. No. 5,557,891 is also identified as a Parent Application to the present Application. Said 891 Patent describes a gutter protection system comprising a double water flow reversal effecting system.

The above survey of Patents shows that numerous systems for preventing clogging of gutter systems have been invented and Patented. Users of many of said systems, however, have found that there remains need for improvement, particularly as regards ease of system installation and effective operation. The present invention provides a system which demonstrates improvement over the known identified existing art.

DISCLOSURE OF THE INVENTION

The present invention comprises a gutter protection system which, in use, is affixed between a lower edge of a sloped building roof and a forward upper aspect of a gutter system, where said gutter system is affixed to a sloped roof building at a lower edge of, and below, said sloped roof. A major focus of the said gutter protection system, in its most preferred embodiment, is the presence of a hem section in a primary body element thereof, which hem section typically comprises, as viewed in right side elevation, a first downward and to the left projecting length of construction material which is merged into a first upward and to the right projecting length of construction material by way of an essentially one-hundred-eighty degree relatively tight bend, such that said hem section opens upward and to the right. (As described in more detail supra herein, it is noted that modified versions within the scope of the present invention gutter protection system are constructed so that said hem section opens other than upward and to the right). In use, said preferred embodiment of the gutter protection system further comprises at least one mounting clip secured at said hem section via a mating projecting lip thereof, said mounting clip(s) being used in interfacing said gutter protection system to said forward upper aspect of said gutter system. Said at least one mounting clip can be placed so as to avoid gutter system mounting spikes and is provided limited three-dimensional motion capability within said hem section, an attribute which facilitates installation. (As is discussed more supra herein, a modified but functionally similar system which is within the scope of the present invention, places a hem section on mounting clip(s) and a mating projecting lip on a gutter protection system primary body element).

In use, a present invention gutter protection system is affixed between a sloped building roof and a forward upper aspect of a gutter system, which gutter system is affixed to a sloped roof building essentially at a lower edge of, and below, said sloped roof.

A primary body element of a most preferred embodiment of the present invention gutter protection system, as viewed in right side elevation prior to affixing to a sloped roof building, generally comprises a hem section, said hem section comprising a first downward and to the left projecting length of construction material which is merged into a first upward and to the right projecting length of construction material by way of an essentially one-hundred-eighty degree relatively tight bend. Said first upward and to the right projecting length of construction material merges, via a relatively tight bend, into a downward and to the right projecting length of construction material. Said downward and to the right projecting length of construction material is merged, via a relatively tight bend, into an upward and to the right projecting length of construction material. Said upward and to the right projecting length of construction material is comprised of openings which allow water flowing thereonto in use to pass therethrough and enter an underlying gutter system, and is merged, via a relatively tight bend, into an upward and to the left projecting length of construction material of a length such that a leftmost positioned end thereof is positioned vertically above said first upward and to the right projecting length of construction material. Said upward and to the left projecting length of construction material is merged, via a relatively gradual bend, into a left major horizontally to the right projecting length of construction material. Said left major horizontally to the right projecting length of construction material is merged, via a relatively gradual bend, into an upward and to the right projecting length of construction material. Said upward and to the right projecting length of construction material is merged, via a relatively gradual bend, into a downward and to the left projecting length of construction material. Said downward and to the left projecting length of construction material is merged, via a relatively gradual bend, into an upward and to the left projecting length of construction material. Said upward and to the left projecting length of construction material is merged, via a relatively gradual shaped bend, into a right major horizontally to the right projecting length of construction material, and said right major horizontally to the right projecting length of construction material is merged into a horizontally to the left projecting length of construction material via an essentially one-hundred-eighty-degree bend.

(It is noted that the terminology "relatively tight bend" and the like implies a bend which occurs over a relatively "short" length of construction material, while a relatively "gradual shaped bend" and the like occurs over a relatively longer length of construction material. Said distinction, is made for the purpose of being specific as regards the most preferred embodiment of the present invention primary body element, and not for the purpose of limiting the invention. Where spacing and function allow, a "relatively tight bend" can be made more gradual, and a relatively "gradual shaped bend" made tighter, without escaping the scope of the present invention).

In all most preferred embodiments, said at least one mounting clip is secured in a hem section by causing a projecting lip of said at least one mounting clip to be present between the downward and to the left and the upward and to the right lengths of construction material in said gutter protection system, which form said hem section.

In the case where a "K-Style" gutter system is present, said mounting clip effects securing said present invention gutter protection system thereto by causing a projecting lip of said mounting clip to be present between the downward and to the left and the upward and to the right lengths of construction material which form said hem section. Said projecting lip is projected upward and to the right, as viewed in right side elevation. Said projecting lip is merged into an arcuate shaped section of construction material which opens generally to the left, by way of a downward and to the right projecting length of construction material, and said arcuate shaped section of construction material is merged into a second upward and to the right projecting length of construction material, optionally via an an essentially horizontally to the left projecting and/or an essentially vertically upward projecting length of construction material. Said second upward and to the right projecting length of construction material is merged into a second downward and to the right projecting length of construction material. The mounting clip elements beyond said projecting lip serve to facilitate interfacing to the forward upper aspect of a "K-style" gutter system in use, and the second downward and to the right projecting length of construction material enables easy removal of said "K-style" mounting clip from a "K-style" gutter system, in use.

In the case where a "Half-Round" gutter system is present, said mounting clip effects securing said present invention gutter protection system thereto by causing a projecting lip of said mounting clip to be present between the downward and to the left and the upward and to the right lengths of construction material which form said hem section. Said projecting lip is projected upward and to the right, as viewed in right side elevation, and is merged into an open arcuate shaped section of construction material which opens generally downward, by way of a downward and typically to the left projecting length of construction material. On at least one side of said open arcuate shaped section of construction material is present a downward and outward, (from a centrally oriented position within said mounting clip), projecting length of construction material, said at least one mounting clip elements beyond said projecting lip serving to facilitate interfacing to the forward upper aspect of a "Half-round" gutter system in use, and which downward and outward, (from a centrally oriented position within said mounting clip), projecting length of construction material, further facilitates easy removal of a said "Half-round" mounting clip from "Half-round" gutter systems, in use.

In the case where a vinyl gutter system is present said mounting clip effects securing said present invention gutter protection system thereto by causing a projecting lip of said mounting clip to be present between the downward and to the left and the upward and to the right lengths of construction material which form said hem section. Said projecting lip is projected upward and to the right, as viewed in right side elevation, and is merged into a common point, by a downward and typically to the left projecting length of construction material. From said common point there are projected a right and a left leg. Said right leg comprises a downward and to the right projecting length of construction material, with said downward and to the right length of construction material being merged into an arcuate shaped section of construction material which opens generally to the left. Said arcuate shaped section of construction material which opens to the left is merged into an arcuate shaped section of construction material which opens generally to the right. Said left leg comprises a downward and to the left projecting length of construction material. At the end of at least said left leg there is present a length of construction material which projects generally downward and outward from an essentially central point within said mounting clip. Said mounting clip elements beyond said projecting lip serve to facilitate interfacing to the forward upper aspect of a "vinyl" gutter system in use, and said length of construction material which projects generally downward and outward from an essentially central point within said mounting clip serves further to facilitate easy removal of a said "Vinyl" mounting clip from "vinyl" gutter systems, in use. (It is also to be noted that one or both of the arcuate sections in a "Vinyl" gutter system type mounting clip right leg can be formed as a bend with relatively straight lengths of construction material projecting therefrom, (eg. essentially "V" shaped), and be within the descriptive language recited above).

It is to be understood that a preferred embodiment mounting clip is secured to said present invention gutter protection system primary body element hem section, (which again, comprises of a first downward and to the left projecting length of construction material which is merged into a first upward and to the right projecting length of construction material by way of an essentially one-hundred-eighty degree bend), by causing an upward and to the right projecting lip thereof to be present between the downward and to the left and the upward and to the right lengths of construction material which form said gutter protection system primary body element hem section. As viewed from above, it should be appreciated, said mounting clip can be rotated through some angle without being removed from said hem section, and as viewed in side elevation it should be also appreciated that said mounting clip can rotate through some limited angle by causing a lower portion of said hem section to bend. In combination with an ability of a projecting lip to move laterally along a hem section, limited three-dimensional motion is enabled thereby serving to facilitate installation of said gutter protection system to gutter systems which present with non-uniform forward upper aspects.

A most preferred method of the present invention comprises the steps of:

a. Providing a most preferred embodiment gutter protection system as described infra herein.

b. Securing at least one mounting clip presenting with a projecting lip to said gutter protection system, by causing a projecting lip thereof to be present between the first downward and to the left and the first upward and to the right lengths of construction material which form said hem section.

c. Causing said left major horizontally to the right projecting length of construction material to assume an angle with respect to said major right horizontally to the right projecting length of construction material by a bending about intervening gutter protection system elements, said angle being selected to match the slope of said sloped building roof.

d. Simultaneously causing said at least one mounting clip to interface to a forward upper aspect of a gutter system which is affixed to said slopped roof building at the edge of, and below, said sloped roof, and said right horizontally to the right projecting length of construction material to be inserted beneath a first row of shingles present at a lower extent of said sloped roof.

It is to be understood that the preceding has described a most preferred embodiment of a present invention gutter protection system mounting system and method of affixing said most preferred gutter protection system to a sloped roof building to which is mounted a gutter system at essentially at a lower edge of, and below, said sloped roof.

Continuing, it is to be appreciated that the most preferred embodiment of the present invention provides a hem on a present invention gutter protection system primary body element, and a projecting lip on mounting clips appropriate for interfacing to a K-Style, or Half-round or Vinyl gutter system. The present invention system and method is, however, not limited in scope to the most preferred embodiment. As better described in the Detailed Description Section herein in combination with the accompanying Figures, the present invention includes functionally similar systems wherein a hem section is located on present invention mounting clips, and wherein a mating projecting lip is present on a present gutter protection system primary body element. In addition, it is to be understood that a hem and projecting lip need not open toward or project in, respectively, any particular direction to be within the scope of the present invention. It is only necessary that functional mating between a projecting lip and a hem section be possible in use.

In a more general sense then, it is to be understood that the present invention is a gutter protection system which in use is affixed between a sloped building roof and a forward upper aspect of a gutter system, when said gutter system is affixed to a sloped roof building essentially at a lower edge of, and below, said sloped roof. Said gutter protection system primary body element comprises an element selected from the group consisting of: (a projecting lip, and a hem section comprising, as viewed in right side elevation, a first projecting length of construction material which is merged into a generally oppositely directed projecting length of construction material, either directly or via intervening length(s) of construction material). Said gutter protection system further comprises at least one mounting clip secured at said element selected from the group consisting of: (a lip and a hem section, said at least one mounting clip comprising an element selected from the group consisting of: (a hem section comprising, as viewed in right side elevation, a first projecting length of construction material which is merged into an oppositely directed projecting length of construction material, either directly or via intervening lengths of construction material, and a projecting lip). Said at least one mounting clip serves, in use, to interface said gutter protection system to said forward upper aspect of said gutter system where said at least one mounting clip is secured to said gutter protection system by causing a hem section or projecting lip of said at least one mounting clip to mate with a projecting lip or hem section, respectively, of said gutter protection system. A general present invention gutter protection system primary body element, as viewed in right side elevation prior to being affixed to said sloped roof building at essentially the edge of, and below, said sloped roof, can further comprise, merging from said projecting lip or hem section, elements as previously described herein with resepct to the most preferred embodiment.

In particular it is specifically noted that a present invention gutter protection system can have a projecting lip present on said primary body element of the gutter protection system and a mating hem section present on said at least one clip; or said present invention gutter protection system can have a hem section present on said primary body element of said gutter protection system and a mating projecting lip present on said at least one clip. It is even possible that both a mounting clip and a primary body element can have hem sections present, where a length of projecting construction material of one said hem functionally section serves as a projecting lip.

It is again noted that while a most preferred present invention gutter protection system embodiment is realized where said hem section is present on said primary body element of the gutter protection system and is comprised of a first downward and to the left projecting length of construction material which merges into a first upward and to the right projecting length of construction material by way of an essentially one-hundred-eighty degree bend, the present invention is not limited thereto and includes functional equivalents, including embodiments wherein oppositely projected lengths of construction material have intervening lengths of construction material therebetween. The defining criteria of a hem section being that a projecting lip can slide therein over some lateral distance without being removed therefrom.

A more general method of affixing a more general present invention gutter protection system to a sloped roof building can comprise the steps of:

a. providing a gutter protection system which in use is affixed between a sloped building roof and a forward upper aspect of a gutter system, which gutter system is affixed to a sloped roof building essentially at a lower edge of, and below, said sloped roof; said gutter protection system, as viewed in right side elevation, prior to affixing to a sloped roof building, comprising an element selected from the group consisting of: (a projecting lip and a hem section, said hem section comprising a first projecting length of construction material which is merged, either directly or via intervening lengths of construction material, into a generally oppositely directed projecting length of construction material), said primary body element being otherwise as described infra herein with respect to the most preferred embodiment;

b. securing at least one mounting clip presenting with an element selected from the group consisting of: (a hem section, said hem section comprising a first projecting length of construction material which is merged, either directly or via intervening lengths of construction material, into an oppositely directed projecting length of construction material, and a projecting lip), to said gutter protection system, by causing said projecting lip to be present between the first projecting length of construction material and the oppositely directed length of constructed material;

c. causing said left major horizontally to the right projecting length of construction material to assume an angle with respect to said major right horizontally to the right projecting length of construction material by a bending about intervening gutter protection system elements, said angle being selected to match the slope of said sloped building roof; and d. simultaneously causing said at least one mounting clip to interface to a forward upper aspect of a gutter system which is affixed to said building at the edge of, and below, said sloped roof, and said right horizontally to the right projecting length of construction material to be inserted beneath a first row of shingles present at a lower extent of said sloped roof.

Said method can also include securing a present invention gutter protection system to a sloped roof building by use of a Mounting Bracket. This, it is emphasised, can be done instead of placing the present invention gutter protection system right major horizontally to the right projecting length of construction material under a row of shingles to secure it in place, or in conjunction therewith. A Mounting Bracket which allows securing a present invention gutter protection system at the effective "hem" formed beneath the present invention gutter protection system right major horizontally to the right projecting length of bracket material, is comprised of, as viewed in right side elevation, a first downward projecting length of bracket material which is merged into a first upward projecting length of bracket material by an essentially one-hundred-eighty degree bend. Said first upward projecting length of bracket material is merged into a generally to the left projecting length of bracket material, which merges into a generally upward to the right projecting length of bracket material via a generally arcuate shaped length of bracket material. Said generally upward to the right projecting length of bracket material merges into a generally to the left projecting length of bracket material via a generally arcuate shaped length of bracket material. As mentioned, said generally to the left projecting length of bracket material, in use, projects as a projecting lip into a "hem" section formed between present invention gutter protection system downward and to the left projecting length of construction material and the right major horizontally to the right projecting length of construction material, while the first downward projecting length of bracket material, which is merged into a first upward projecting length of bracket material by an essentially one-hundred-eighty degree bend, is secured to a wall of a sloped roof building, typically by one or more screws. Functional equivalents of said described mounting bracket are within the scope of said descriptive language.

Continuing, in use, a gutter protection system mounting clip hem section or projecting lip is oriented so as to mate with a gutter protection system primary body element projecting lip or hem section, respectively, and said mounting clip as viewed in right side elevation, is further comprised of a shape selected from the group consisting of:

a. a mounting clip hem section or projecting lip which is merged into an arcuate shaped section of construction material which opens generally to the left, by way of a downward and to the right projecting length of construction material, said "K-style" gutter system mounting clip being otherwise as described infra;

b. a mounting clip hem section or projecting lip which is merged into an open arcuate shaped section of construction material which opens generally downward, by way of a generally downward projecting length of construction material, said "Half-round" gutter system mounting clip being otherwise as described infra;

c. a mounting clip hem section or projecting lip which is merged into a common point, by a generally downward projecting length of construction material, said "Vinyl" gutter system mounting clip being otherwise as described infra;

such that as viewed from above, said projecting lip can be rotated without being removed from said hem section, and such that as viewed in side elevation said mounting clip can be rotated without said projecting lip being removed from said hem section, said rotations serving to, in combination with longitudinal positioning along a length of gutter protection system, allow limited three-dimensional motion of said at least one mounting clip without removal of said projecting lip from said hem section, and thereby facilitate installation of said gutter protection system to gutter systems which present with non-uniform forward upper aspects.

An alternative description of a general present invention gutter protection system includes combination with an underlying gutter system, wherein said gutter protection system serves, in use, to direct rain water into said underlying gutter system to which it is affixed, while preventing the entry of debris thereonto, which underlying gutter system is affixed essentially at a lower edge of a sloping building roof. Said gutter protection system comprises a primary body element in which is present a "water flow slowing means" which serves to essentially reverse the direction of flow of rain water at least twice between the entry of said rain onto said gutter protection system, and the flow of said rain water into said underlying gutter system, which gutter protection system utilizes capillary action to direct said rain water flow through said water flow slowing means during use. Said gutter protection system further comprises an element selected from the group consisting of: (a projecting lip, and a hem section comprising, as viewed in right side elevation, a first projecting length of construction material which is merged directly, or via intervening lengths of construction material, into an oppositely directed projecting length of construction material). Said gutter protection system further comprising at least one mounting clip secured at said element selected from the group consisting of: (a projecting lip, and a hem section), with said at least one mounting clip comprising an element selected from the group consisting of: (a hem section comprising, as viewed in right side elevation, a first projecting length of construction material which is merged directly, or via intervening lengths of construction material, into an oppositely directed projecting length of construction material). Said at least one mounting clip serves in use to interface said gutter protection system to said forward upper aspect of said gutter system. It is to be particularly appreciated that said at least one mounting clip is, in use, secured to said gutter protection system by causing a mating hem section or projecting lip of said at least one mounting clip to mate with a projecting lip or hem section, respectively, of said gutter protection system.

It is further clarified that the water flow slowing means in a present invention gutter protection system as just described can comprise an "S" shape; or an "S" shape with the upper portion thereof collapsed; a "V" shape followed by an Inverted "V" shape; or other functional shape.

The present invention system will be better understood by reference to the Detailed Description Section herein, in conjunction with the accompanying drawings.

SUMMARY OF THE INVENTION

A purpose of the present invention is to provide a gutter protection system of a design which functionally combines with present invention mounting clip designs so as to facilitate mounting of the present invention gutter protection system to "K-type", "Half-round" and "Vinyl" gutter systems on sloped roof buildings, via hem and projecting lip mating.

Another purpose of the present invention is to provide mounting clips which are of designs which facilitate mounting and removal of the present invention gutter protection system to "K-type", "Half-round" and "Vinyl" gutter systems.

Yet another purpose of the present invention is to provide a gutter protection system which effects at least two direction of water flow reversals and prevents debris from entering to an underlying gutter system while allowing water to enter thereto, in use.

Still yet another purpose of the present invention is to provide a gutter protection system of a design which facilitates easy mounting thereof to a sloped roof building.

Yet still another purpose of the present invention is to provide a method of installation of gutter protection systems which facilitates easy mounting thereof to a sloped roof building.

BRIEF DESCRIPTION OF THE DRAWINGS

FIG. 1 generally shows a gutter protection system of the present invention mounted to gutter system present at a lower edge of a building sloped roof.

FIG. 2*a* shows a hem section of a present invention gutter protection system for use into which projecting lips of mounting clips are secured during use.

FIG. 2*b*1 shows a projecting lip of a mounting clip secured in a present invention K-style gutter protection system hem section.

FIG. 2*b*2 shows a projecting lip of a present invention gutter protection system secured in a mounting clip hem section.

FIG. 2*b*3 shows a drawing similar to that in FIG. 2*b*1, but for a half-round gutter protection system.

FIG. 2*b*4 shows a drawing similar to that in FIG. 2*b*1, but for a vinyl gutter protection system.

FIG. 3*a*1 shows a right side elevational profile of a most preferred embodiment of a present invention gutter protection system.

FIG. 3*a*2 shows a right side elevational profile of a modified embodiment of a present invention gutter protection system.

FIG. 3*b*1 shows holes in a section of the gutter protection system of FIG. 3*a*1 through which water can pass into an underlying gutter during use.

FIG. 3*b*2 shows holes in a section of the gutter protection system of FIG. 3*a*1 through which water can pass into an underlying gutter during use.

FIG. 4*a* shows a mounting clip appropriate for use in mounting the gutter protection system of FIG. 3*a*1 to a "Type-K" gutter system.

FIG. 4*b* shows a mounting clip appropriate for use in mounting the gutter protection system of FIG. 3*a*2 to a "Type-K" gutter system.

FIG. 5*a* shows a mounting clip appropriate for use in mounting the gutter protection system of FIG. 3*a*1 to a "Half-Round" gutter system.

FIG. 5*b* shows a mounting clip appropriate for use in mounting the gutter protection system of FIG. 3*a*2 to a "Half-Round" gutter system.

FIG. 6*a* shows a mounting clip appropriate for use in mounting the gutter protection system of FIG. 3*a*1 to a "Vinyl" gutter system.

FIG. 6*b* shows a mounting clip appropriate for use in mounting the gutter protection system of FIG. 3*a*2 to a "Vinyl" gutter system.

FIGS. 7*a* and 7*b* demonstrate the flexibility provided by projecting lip and hem section coordination, in that the projecting lip can essentially rotate a bit within said hem section.

DETAILED DESCRIPTION

Figure 8A:
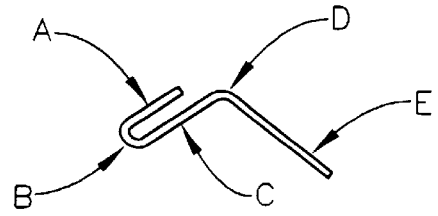
FIGS. 8*a*–8*l* show modified gutter protection system hem and mounting clip projecting lip geometry combinations.

Turning now to the Drawings, it is indicated in FIG. 1 that the present invention includes a gutter protection system (GPS) which in use is affixed between a sloped building roof and a forward upper aspect (FA) of a gutter system (GS). Said gutter system (GS) is shown as being affixed to a building with a sloped roof, at a lower edge of and below, said sloped roof.

FIG. 2*a* shows that a major focus of a most preferred embodiment present invention gutter protection system is a hem section (HS) comprising, as viewed in right side elevation, a first generally downward, and to the left, projecting length of construction material (A) which is merged into a first upward and to the right, projecting length of construction material (C) by way of an essentially one-hundred-eighty degree bend. (Note that said hem section (HS) has a closed end at the essentially one-hundred-eighty degree relatively tight bend, and is open at an opposite end). In use said gutter protection system (GPS) further comprises at least one mounting clip secured at said hem section, said mounting clip(s) being used in interfacing said gutter protection system (GPS) to said forward upper aspect of said gutter system (GS).

FIG. 2*b*1 shows an expanded view of the portion of the gutter protection system (CPS) shown in FIG. 2*a*, with a present invention mounting clip (MCK), (see FIG. 4*a*), projecting lip (PLK) secured in the hem section (HS), said mounting clip (MCK) being shown situated with respect to the upper forward portion of a gutter system (GS), as more generally shown in FIG. 1. It should be appreciated that said projecting lip (PLK) can rotate in said hem section (HS), (in the plane of the paper as shown), to a limited degree by causing the lower portion of said hem section to bend downward, (indicated by the dotted and solid (A) lengths of construction material in FIG. 2*a*), and by effecting bending between, for instance, elements (PLK) and (AS1K) in FIG. 2*b*1. This provides mounting facilitating capability where a gutter system is of irregular shape. (Note, as discussed more surpa herein, in relationship to FIGS. 3*a*2, 4*b*, 5*b* and 6*b*, FIG. 2*b*2 shows a modified embodiment of the present invention wherein a Mounting clip (MCK) has a hem section (eg. (PLK) and (PLK')), and a mating projecting lip (C) on a gutter protection system are present). FIGS. 2*b*3 and 2*b*4 show Half-Round and Vinyl Mounting Clips (MCR) (MCV), with FIG. 2*b*4 showing a non-preferred (MCV) oriented to project a (GPS) hem section (HS) beyond the Gutter System (GS).

FIG. 3*a*1 shows that a preferred embodiment of the present invention gutter protection system primary body element can be disclosed by description of a right side elevational view thereof, prior to mounting thereof to a sloped roof building. Such a right side elevational view provides that said first downward and to the left projecting length of construction material (A) which is merged into a first upward and to the right projecting length of construction (C) material by way of an essentially one-hundred-eighty degree bend (B) involving construction material of approximately 0.093 inches long, is approximately 0.346 inches long. Said first upward and to the right projecting length of construction material (C), is approximately 0.383 inches long and merges, via a relatively tight bend (D) involving construction material of approximately 0.039 inches long, into a downward and to the right projecting length of construction material (E) of approximately 0.544 inches long. Said downward and to the right projecting length of construction material (E) is merged, via a relatively tight bend (F) involving construction material of approximately 0.0.086 inches long, into an upward and to the right projecting length of construction material (G) of approximately 0.231 inches long. Said upward and to the right projecting length of construction material (G) is comprised of openings (GH) (see FIG. 3*b*1), which allow water flowing thereonto in use to pass therethrough and enter an underlying gutter system, and is merged, via a relatively tight bend (H) involving construction material of approximately 0.0.085 inches long, into an upward and to the left projecting length of construction material (I) of approximately 0.841 inches long, said length providing that a leftmost positioned end thereof, (at (J)), is vertically above said first upward and to the right projecting length of construction material (C). Said upward and to the left projecting length of construction material (I) is merged, via a relatively gradual bend (J) involving construction material of approximately 0.25 inches long, into a left major horizontally to the right projecting length of construction material (K) of approximately 3.435 inches long. Said left major horizontally to the right projecting length of construction material (K) is merged, via a relatively gradual bend (L) involving construction material of approximately 0.014 inches long, into an upward and to the right projecting length of construction material (M) of approximately 0.271 inches long. Said upward and to the right projecting length of construction material (M) is merged, via a relatively gradual bend (N) involving construction material of approximately 0.183 inches long, into a downward and to the left projecting length of construction material (O) of approximately 0.245 inches long. Said downward and to the left projecting length of construction material (O) is merged, via a relatively gradual bend (P) involving construction material of approximately 0.019 inches long, into an upward and to the left projecting length of construction material (Q) of approximately 0.125 inches long. Said upward and to the left projecting length of construction material (O) is merged, via a relatively gradual shaped bend (R) involving construction material of approximately 0.139 inches long, into a right major horizontally to the right projecting length of construction material (S) of approximately 3.689 inches long, and said right major horizontally to the right projecting length of construction material (S) is merged into a horizontally to the left projecting length of construction material (U) of approximately 0.220 inches long via an essentially one-hundred-eighty-degree bend (T) involving construction material of approximately 0.104 inches long.

It is to be understood that the provided length dimensions are demonstrative, and are not to be interpreted as limiting.

Continuing, in all embodiments, at least one mounting clip is secured to a hem section by causing a projecting lip to be present between the lengths of construction material which form said hem section.

FIG. 4*a* shows that, in the case where a "K-Style" gutter system is present, said mounting clip (MCK) comprises a projecting lip, said projecting lip (PLK) being projected upward and to the right, as viewed in right side elevation. Said projecting lip (PLK) is caused to be present between the downward and to the left (A) and the upward and to the right (C) lengths of construction material which form said hem section shown in FIG. 3*a*1 in use. Said projecting lip (PLK) is shown as merged into an arcuate shaped section (ASIK) of construction material which opens generally to the left, by way of a downward and to the right projecting length of construction material (DR1K), and said arcuate shaped section (AS1K) of construction material is merged into a second upward and to the right projecting length of construction material (UR1K) via an essentially vertically upward projecting intervening length of construction material (UR2K). (Note, that said arcuate shaped section (AS1K) can be flattened on its lower side as shown, thereby forming what can be viewed as a second intervening length of construction material). Said second upward and to the right projecting length of construction material (UR1K) is merged into a second downward and to the right length of construction material (DR1K'). Note that said essentially vertically upward projecting length of construction material (UR2K) can be eliminated in a modified embodiment and/or element (AS1K) can be more arcuate in shape with element (DR1K) less pronounced as a seperatly identifiable length of construction material. The mounting clip elements beyond said projecting lip serving to facilitate interfacing to the forward upper aspect of a "K-style" gutter system, and element (DR1K') also enables easy removal of a mounting clip (MCK) in use).

Turning now to FIG. 5*a*, in the case where a "Half-Round" gutter system is present, said mounting clip (MCR) is secured thereto by causing a projecting lip (PLR) thereof to be present between the downward and to the left (A) and the upward and to the right (C) lengths of construction material which form said hem section shown in FIG. 3*a*1. Said projecting lip (PLR) being projected upward and to the right, as viewed in right side elevation, and being merged into an open arcuate shaped section (AS1R) of construction material which opens generally downward, by way of a downward and typically to the left projecting length of construction material (DL1R). At at least one side said open arcuate shaped section of construction material is present a downward and outward, (DO1R) (from an essentially centrally located position within said mounting clip), projecting length of construction material, said at least one mounting clip elements beyond said projecting lip serving to facilitate interfacing to the forward upper aspect of a "half-round" gutter system in use. In particularly, the downward and outward projecting length of construction material (DO1R) serves to assure that the open arcuate shaped section (AS1R) will spread open when said mounting clip (MCR) is placed onto a "Half-Round" gutter system. (Element (DO1R) also facilitates mounting clip (MCR) removal in use).

Turning now to FIG. 6*a*, in the case where a vinyl gutter system is present said mounting clip (MCV) is secured thereto by causing a projecting lip (PLV) thereof to be present between the downward and to the left (A) and the upward and to the right (C) lengths of construction material which form said hem section shown in FIG. 3*a*1. Said projecting lip (PLV) being projected upward and to the right, as viewed in right side elevation, and is merged into a common point (CP), by a downward and typically to the left projecting length of construction material (DL1V). From said common point (CP) there are projected a right (RL) and a left leg (LL). Said right leg (RL) comprises a downward and to the right length of construction material (DR1V), said downward and to the right length of construction material (DR1V) being merged into an arcuate shaped section of construction material (ASLV) which opens generally to the left, said arcuate shaped section of construction material (ASLV) which opens to the left being merged into an arcuate shaped section of construction material (ASRV) which opens generally to the right. Said left leg (LL) comprises a downward and to the left projecting length of construction material (DL1V'). At the end of at least said left leg there is present a length of construction material (DO1V) which projects generally downward and outward from a central point within said mounting clip (MCV). Said mounting clip (MCV) elements beyond said projecting lip (PLV) serve to facilitate interfacing to the forward upper aspect of a "Vinyl" gutter system in use. In particular, the shown generally downward and outward to the left length of construction material from said common point (DO1V), and the lower portion of arcuate shaped length of construction material (ASRV) which projects to the right, provide a shape which assures that said elements will spread apart when said mounting clip (MCR) is placed onto a "Vinyl" gutter system. (Element (DO1V) also facilitates easy mounting clip (MCR) removal in use). It is also noted that the arcuate shaped section of construction material (ASLV) which opens generally to the left, and said arcuate shaped section of construction material (ASRV) which opens generally to the right, as shown, can involve tighter bends as shown, and remain within the scope of the present invention.

It is to be understood then that a mounting clip is secured to said hem section comprised of a first downward and to the left (A) projecting length of construction material which is merged into a first upward and to the right projecting length of construction material (C) by way of an essentially one-hundred-eighty degree bend (B), by causing an upward and to the right projecting lip (PLK) (PLR) (PLV) thereof to be present between the downward and to the left (A) and the upward and to the right (C) lengths of construction material which form said hem section (HS).

Turning now to FIGS. 7*a* and 7*b*, it will be appreciated that, as viewed from above, a mounting clip projecting lip (PL) can be rotated through some angle, (in the plane of the paper as shown), without being removed from said hem section (HS), said rotation serving to facilitate installation of said gutter protection system to gutter systems which present with non-uniform shaped forward upper aspects. In conjunction with the available additional dimensional rotation motion as viewed in side elevation and described with respect to FIG. 2*a*, (see discussion infra herein), it should be appreciate that said projecting lip (PL) can rotate in said hem section (HS) to limited degrees in two-dimensions, with positioning of clips along a length of gutter protection system providing a third degree of freedom. This provides a user great mounting facilitating capability and is considered a very important aspect of the present invention.

FIG. 3*a*2 shows a modified version of the gutter protection system shown in FIG. 3*a*1, in which a hem section is not present. In particular note that the length of construction (C) serves as a projecting lip which mates with a hem present in mounting clips as shown in FIGS. 4*b*, 5*b* and 6*b*.

FIG. 3*a*2 shows that said modified version of the present invention gutter protection system comprises a first upward and to the right projecting length of construction (C) material, said first upward and to the right projecting length of construction material (C), being a projecting lip of approximately 0.383 inches long and merging, via a relatively tight bend (D) involving construction material of approximately 0.039 inches long. The description of FIG. 3*a*1 is threafter equally valid for FIG. 3*a*2.

It is again to be understood that the provided length dimensions are demonstrative, and are not to be interpreted as limiting.

Continuing, in all preferred embodiments, said at least one mounting clip is secured to the hem section by causing a projecting lip thereof to be present between the downward and to the left and the upward and to the right lengths of construction material which form said hem section.

FIG. 4*b* shows that, in the case where a "K-Style" gutter system is present, said mounting clip (MCK) comprises a hem section which is formed from a length of construction material (PLK') which is merged into a length of construction material (PLK) by an essentially one-hundred-eighty degree bend, said hem section opening upward and to the right, as viewed in right side elevation. Said hem section is caused to be mated with the upward and to the right (C) length of construction material which comprises the gutter protection system projecting lip in use. Said hem section length of construction material (PLK) is merged into an arcuate shaped section (AS1K) of construction material which opens generally to the left, by way of a downward and to the right projecting length of construction material (DR1K). The mounting clip shown in FIG. 4*b* is otherwise the same as that described with respect to FIG. 4*a*.

Turning now to FIG. 5*b*, in the case where a "Half-Round" gutter system is present, said mounting clip (MCR) comprises a hem section which is formed from a length of construction material (PLR') which is merged into a length of construction material (PLR) by an essentially one-hundred-eighty degree bend, said hem section opening upward and to the right, as viewed in right side elevation. Said hem section is caused to be mated with the upward and to the right projecting length of construction material which comprises the gutter protection system projecting lip (C) in use. Said length of construction material (PLR) is projected upward and to the right, as viewed in right side elevation, and merged into an open arcuate shaped section (AS1R) of construction material which opens generally downward. The mounting clip of FIG. 5*b* is otherwise the same as that described with respect to FIG. 5*a*.

Turning now to FIG. 6*b*, in the case where a vinyl gutter system is present said mounting clip (MCV) comprises a hem section which is formed from a length of construction material (PLV') which is merged into a length of construction material (PLV) by an essentially one-hundred-eighty degree bend, said hem section opening upward and to the right, as viewed in right side elevation. Said hem section is caused to be mated with the upward and to the right projecting length of construction material which comprises the gutter protection system projecting lip (C) in use. said length of construction material (PLV) is projected upward and to the right, as viewed in right side elevation, and is merged into a common point (CP), by a downward and typically to the left projecting length of construction material (DL1V). The mounting clip of FIG. 6*b* is otherwise the same as that described with respect to FIG. 6*a*.

The foregoing description shows present invention systems which have a hem (HS') section present on mounting clips and a mating projecting lip present on a gutter protection system primary body element. In addition, the hem section is described as being formed from downward and to the left, and upward and to the right projecting lengths of construction material. However, it is to be understood that it is within the scope of the present invention to provide a hem section (HS) on the primary body element of a gutter protection system and a projection lip on mounting clips, and further, projecting lips can project other than downward and to the left and hem sections can open other than upward and to the right. FIGS. 8*a*–8*l* and 9*a*–9*m* and 10*a*–10*d* demonstrate various alternative embodiments of the present invention.

FIGS. 7*a* and 7*b* are again referenced to demonstrate that hem section (identified for the purposes of this paragraph as (PL)), can be rotated through some angle, (in the plane of the paper as shown), without said projecting lip (identified for the purposes of this paragraph as (HS)) being removed therefrom, said rotation serving to facilitate installation of said gutter protection system to gutter systems which present with non-uniform shaped forward upper aspects.

Continuing, to make it clear that any combination of projecting lip and hem section mounting means are to be considered within the scope of the present invention, FIGS. 8*a*–10*d* are provided to show various included geometries.

Figure 8B:
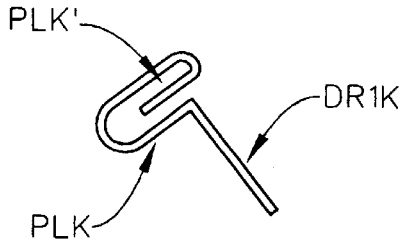
Figure 8C:
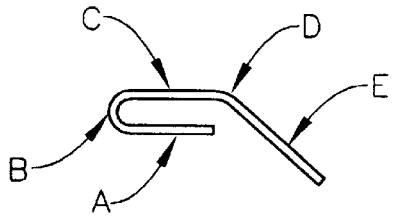
Figure 8D:
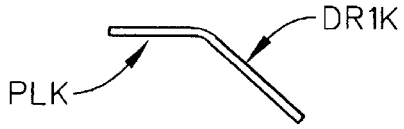
Figure 8E:
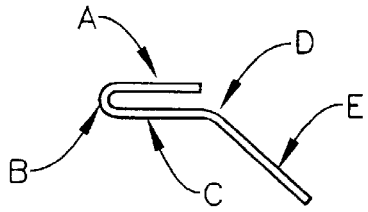
Figure 8F:
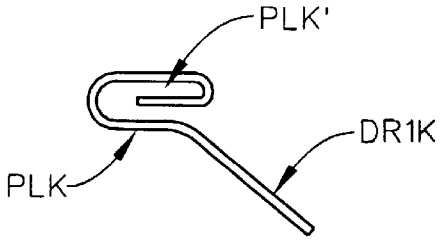
Figure 8G:
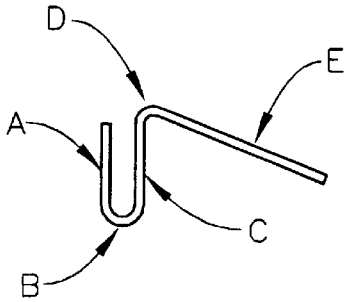
Figure 8H:
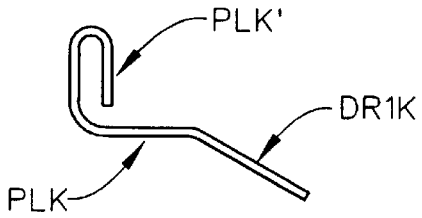
Figure 8I:
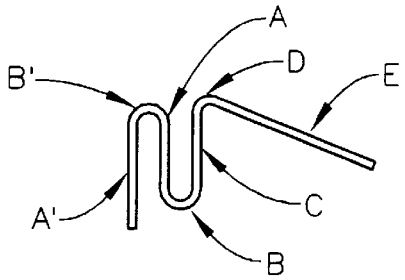
Figure 8J:
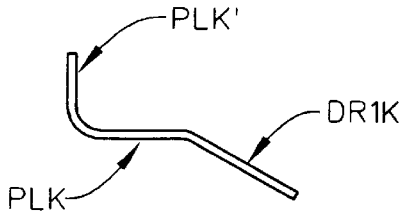
Figure 8K:
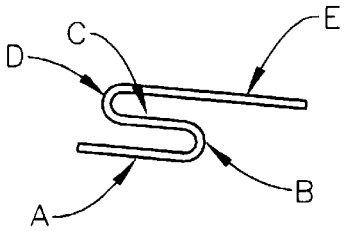
Figure 8L:
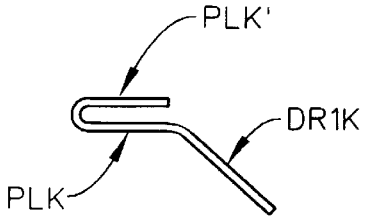

FIG. 8*a* shows a hem containing portion of a present invention , in which the hem opens essentially upward and to the right, much as is the case in the FIG. 3*a*1 preferred embodiment. However, in FIG. 8*a* the length of construction material labeled (A) is shown to be positioned above the length of construction material labeled (C), in contrast to the case shown in FIG. 3*a*1. FIG. 8*b* shows a portion of a K-Style mounting clip with a projecting lip (PLK') shown projecting essentially downward and to the left. The orientation of the projecting lip (PLK') is similar to the projecting lip (PLK) in FIG. 4, but it is to be noted that (PLK') is positioned above (PLK) such that it can project into FIG. 8*a* hem formed between FIG. 8*a* lengths of construction material (A) and (C). FIG. 8*c* shows a modification of FIG. 3*a*1 in that the hem between lengths of construction material (A) and (C) opens essentially to the right instead of upward and to the right. FIG. 8*d* shows a projecting lip (PLK) which projects essentially to the left so as to allow fitting into said FIG. 8*c* hem. FIG. 8*e* shows another portion of a gutter protection system primary body element hem which opens essentially to the right, but it is to be noted that the length of construction material labeled (A) is positioned above the length of construction material labeled (B). FIG. 8*f* shows a portion of a K-Style mounting clip with a projecting lip (PLK') oriented so as to mate with the FIG. 8*e* hem. FIG. 8*g* shows a portion of a gutter protection system primary body element with a hem formed between lengths of construction material labeled (A) and (C) which opens essentially upward, and FIG. 8*h* shows a portion of a K-Style mounting clip with a projecting lip (PLK') oriented to mate with said FIG. 8*g* hem. FIG. 8*i* shows a portion of a gutter protection system primary body element with a hem formed between lengths of construction material labeled (A') and (A) which opens essentially downward, and FIG. 8*j* shows a portion of a K-Style mounting clip with a projecting lip (PLK') oriented so as to mate with said FIG. 8*i* hem. FIG. 8*k* shows a portion of a gutter protection system primary body element with a hem formed between lengths of construction material labeled (A) and (C), said hem opening essentially to the left. FIG. 8L shows a portion of a K-Style mounting clip with a projecting lip (PLK') oriented so as to mate with said FIG. 8*k* hem.

It is to be noted that the hems in the various FIGS. 8*a,* 8*c,* 8*e,* 8*g,* 8*i* and 8*k* can all be reoriented by rotation, for instance, about length of construction material (D) so as to open slightly other than as shown. For instance, the hem shown in FIG. 8*a* can be rotated to assume the orientation shown in FIG. 8*e,* or FIG. 8*g*. Corresponding projecting lips shown in FIGS. 8*b*, 8*d*, 8*f*, 8*h,* 8*j* and 8*l* can be likewise reoriented by a bending process, (eg. the FIG. 8*d* mounting clip can be bent to resemble the mounting clip shown in FIG. 8*j*). The important thing to note is that a present invention hem can open in essentially any orientation in a three-hundred-sixty degree range taken around length of construction material (D), and a projecting lip of a mounting clip can be made to orient appropriately so as to mate therewith. The presence of a hem in a present invention gutter protection system primary body element, in combination with mating projecting lip in a present invention mounting clip, is to be understood to be sufficient to fall within the scope of the present invention claims. This is the case regardless of orientation of said hem and projecting lip, emphasis added.

Figure 9A:
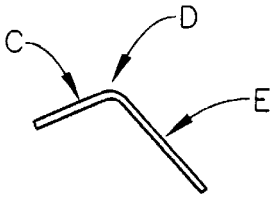
FIGS. 9*a*–9*m* show modified gutter protection system projecting lip and mounting clip hem geometry combinations.
Figure 9B:
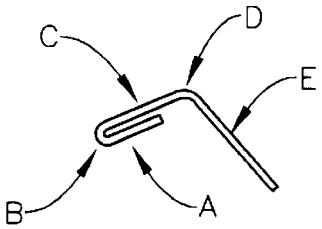
Figure 9C:
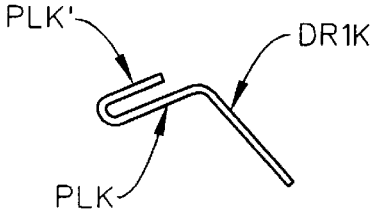
Figure 9D:
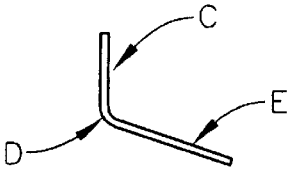
Figure 9E:
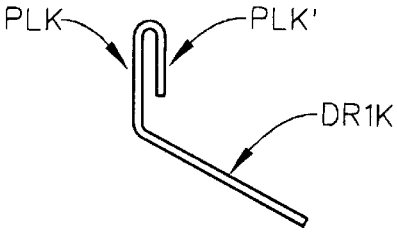
Figure 9F:
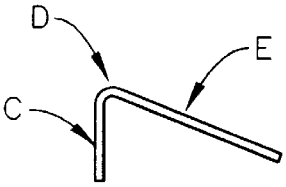
Figure 9G:
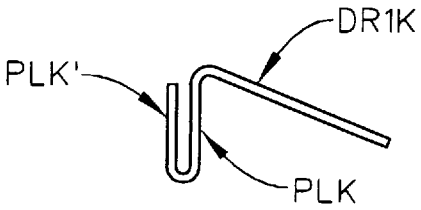
Figure 9H:
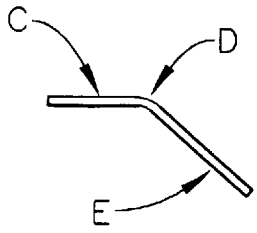
Figure 9I:
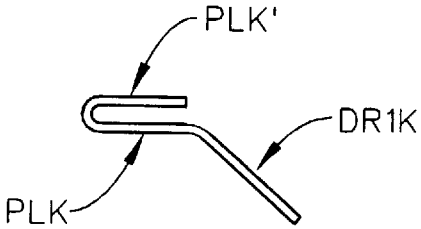
Figure 9J:
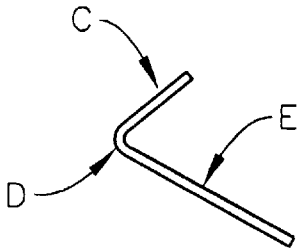
Figure 9K:
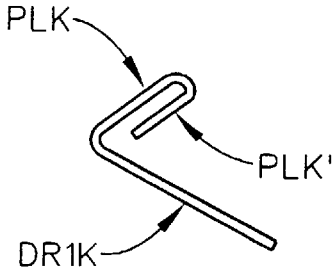
Figure 9L:
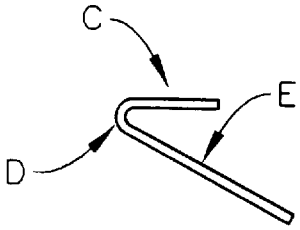
Figure 9M:
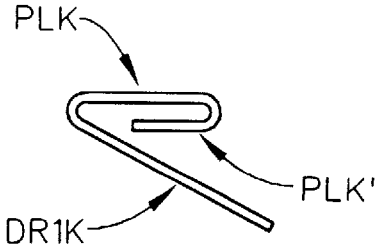
Figure 10A:
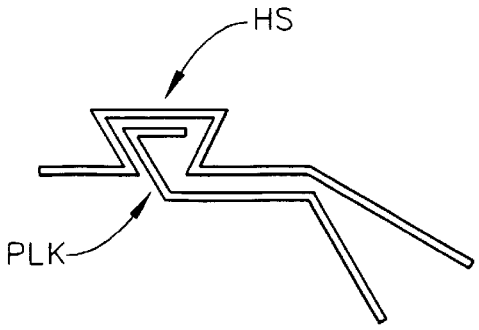
FIGS. 10*a*–10*d* show additional mating hem section and projecting lip geometries.
Figure 10B:
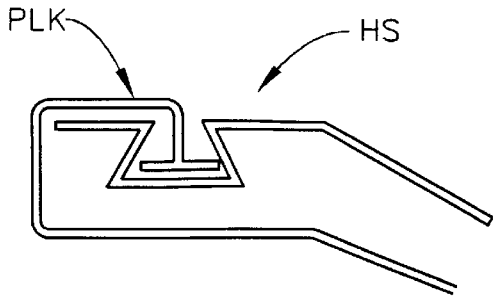
Figure 10C:
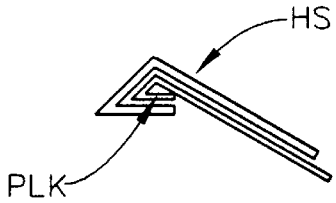
Figure 10D:
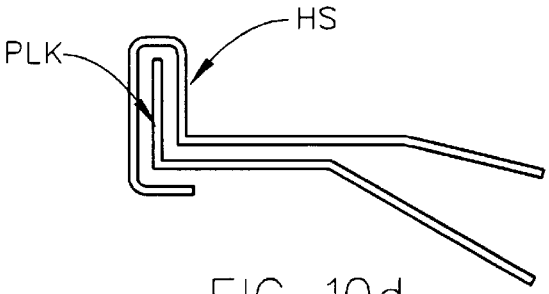

Turning now to FIGS. 9*a*–9*m,* it should be readily appreciated that the present invention also contains within its scope embodiments in which a functionally essentially equivalent projecting lip is present on a present invention gutter protection system primary body element instead of on a mounting clip, and wherein a mating functionally essentially equivalent hem is present on a mounting clip instead of on a present invention gutter protection system primary body element. FIGS. 9*a* and 9*b* show two versions of a projecting lip on a portion of a present invention gutter protection system primary body element. In FIG. 9*a* said projecting lip is shown as a simple length of construction material (C), while in FIG. 9*b* said projecting lip is shown to be formed by a two lengths of construction material (A) and (C) which are forced into contact with one another by very tight bending about a length of construction material (B). It is to be understood that the present invention, in any of its embodiments as shown in any of the Figures, (including reasonable modifications thereof), includes such constructed functional equivalents for any length of construction material. That is, any length of construction material shown as being of single piece construction can be made of functionally similar multiple piece construction, and any length of construction material shown as of multiple piece construction can be made of functionally similar single piece construction. Continuing, FIG. 9*c* shows a portion of a present invention K-Style mounting clip with a hem section present, said hem section being formed between lengths of construction material identified as (PLK') and (PLK). FIG. 9*d* shows a portion of a present invention gutter protection system primary body element with a projecting lip (C) oriented so as to project essentially vertically, and FIG. 9*e* shows a portion of a K-Style present invention mounting clip (MCK) with a hem section formed between lengths of construction material (PLK') and (PLK), oriented so as to allow mating with the FIG. 9*d* gutter protection system primary body element projecting lip (C). FIG. 9*f* shows a present invention gutter protection system primary body element with a projecting lip (C) oriented so as to project downward, and FIG. 9*g* shows a present invention K-Style mounting clip with a hem section formed between lengths of construction material (PLK') and (PLK) oriented so as to allow functional mating with said projecting lip (C) shown in FIG. 9*f*. FIG. 9*h* shows a present invention gutter protection system primary body element with a projecting lip (C) oriented so as to project essentially to the left, and FIG. 9*j* shows a K-Style present invention mounting clip with a hem section oriented so as to open essentially to the right, and thereby allow functional mating with the projecting lip (C) shown in FIG. 9*h*. FIG. 9*j* shows another embodiment of a present invention gutter protection system primary body element with a projecting lip (C) oriented so as to project essentially upward and to the right. FIG. 9*k* shows a present invention K-Style mounting clip with a hem section formed between lengths of construction material (PLK) and (PLK') which opens essentially downward and to the left so as to allow functional mating with said projecting lip (C) shown in FIG. 9*j*. FIGS. 9*l* and 9*m* show essentially the same embodiment of a present invention gutter protection system primary body element with a projecting lip (C) and a present invention K-Style mounting clip, respectively, as shown in FIGS. 9*j* and 9*k,* but with the projecting lip (C) rotated and oriented so as to project to essentially the right and the hem section formed between (PLK') and (PLK) rotated and oriented so as to open essentially to the left. As with respect to FIGS. 8*a*–8*l,* it is important to note that a FIGS. 9*a,* 9*d,* 9*f,* 9*h,* 9*j* or 9L present invention projecting lip can project in essentially any orientation in a three-hundred-sixty degree range taken around length of construction material (D), and a hem of a present invention FIGS. 9*c,* 9*e,* 9*g,* 9*i,* 9*k* or 9*m* mounting clip can be made to open appropriately so as to mate therewith. The presence of a projecting lip in a present invention gutter protection system primary body element, in functional combination with mating hem section in a present invention mounting clip, is to be understood to be sufficient to fall within the scope of the present invention claims. This is the case regardless of orientation of said hem and projecting lip, emphasis added.

FIGS. 10*a*–10*d* show additional variations on Hem Section (HS) and Projecting Lip configurations which are within the scope of the present invention. The main consideration for the presence of a hem section (HS) and a projecting lip (PLK) in the present invention gutter protection system (GPS) being that said projecting lip (PLK) can mountably project into said hem section (HS) in use, and slide therein along a length thereof without being removed therefrom.

(It is also to be understood that while K-Style clips were used for demonstration in discussion of FIGS. 8*a*–8*l* and 9*a*–9*m* and 10*a*–10*d,* mounting clips for use with half-round and vinyl gutter systems are to be considered as functionally equivalent and included within the discussion).

Figure 11:
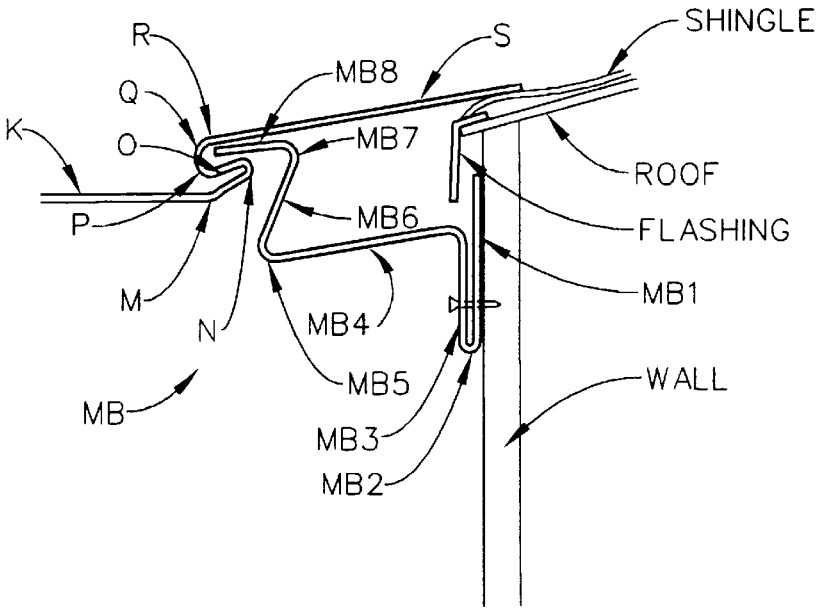
FIG. 11 shows a mounting bracket for mounting a present invention gutter protection system to a sloped roof buliding.

FIG. 11 shows that the present invention gutter protection system (GPS) can be mounted to a sloped roof building by use of a Mounting Bracket (MB). FIG. 1 demonstrated that the present invention gutter protection system (GPS) right major horizontally to the right projecting length of construction material (S) can be placed under a row of shingles to secure it in place. However, in some situations this is not convenient. The Mounting Bracket (MB) allows securing a present invention gutter protection system (GPS) at the "hem" formed between the into a downward and to the left projecting length of construction material (O) and the right major horizontally to the right projecting length of construction material (S), (see FIGS. 3*a*1 and 3*a*2). Said mounting beacket (MB) is shown to be comprised of, as viewed in right side elevation, a first downward projecting length of bracket material (MB1), which is merged into a first upward projecting length of bracket material (MB3) by an essentially one-hundred-eighty degree bend (MB2). Said first upward projecting length of bracket material (MB3) is merged into a generally to the left projecting length of bracket material (MB4), which merges into a generally upward to the right projecting length of bracket material (MB6) via a generally arcuate shaped length of bracket material (MB5). Said generally upward to the right projecting length of bracket material (MB6) merges into a generally to the left projecting length of bracket material (MB8) via a generally arcuate shaped length of bracket material (MB7). As mentioned, said generally to the left projecting length of bracket material (MB8), in use, projects as a projecting lip into a "hem" section formed between present invention gutter protection system (GPS) downward and to the left projecting length of construction material (O) and the right major horizontally to the right projecting length of construction material (S), while the first downward projecting length of bracket material (MB1), which is merged into a first upward projecting length of bracket material (MB3) by an essentially one-hundred-eighty degree bend (MB2) is secured to a wall of a sloped roof building.

It is generally noted that relatively tight bends can be approximated by gradual arcuate shapes, (and vice-versa), which perform the same function, in all the structure described infra herein, particularly as regards the shape of the various mounting clips. In addition, the terms "merge(s)" and "merging" can imply direct interconnection, or interconnection via intervening elements. The claims should be read as sufficiently broad to include such functionally equivalent interpretations.

It is further to be understood that while a projecting lip typically consists of a single projecting thickness of construction material, it is within the scope of the invention to form a double thickness of construction material projecting lip with a tight one-hundred-eighty degree bend therein, (see FIG. 9*b*), and cause said double construction material thickness projecting lip, (one-hundred-eighty degree bend end first), to project into an open end of previously described mating hem section.

It is to be understood that the identifiers present in FIGS. 3*a*1, 3*a*2, 4*a*, 4*b*, 5*a*, 5*b*, 6*a* and 6*b* are utilized in the claims for the purposes of European practice. However, as shown in FIGS. 8*a*–10*d*, it is to be understood that a hem section in a gutter protection system (GPS) primary body element is formed from a projecting length of construction material (A) which is merged into an oppositely directed projecting length of construction material (C) by way of a one-hundred-eighty degree bend (B), as shown in FIG. 8*a* for instance, (although FIG. 9*b* shows that a projecting lip, rather than a hem, section, can be fashioned from lengths of construction material identified as (A) and (C) by a very tight one-hundred-eighty degree bend (B). In addition a hem section in a gutter protection system primary body element can be formed from a length of construction material (A) which is merged into an oppositely directed projecting length of construction material (A') by way of a relatively tight one-hundred-eighty degree bend, as shown in FIG. 8*i* for instance. In the claims, where applicable, functional designators (A) and (C) are to be read to represent all analogically similar cases wherein a hem section is formed from two oppositely directed projecting lengths of construction material present on a gutter protection system (GPS) primary body element, (or mounting clip). Continuing, as FIG. 8*b* shows, for instance, a projecting lip on a mounting clip can consist of a length of construction material designated as (PLK') or as FIG. 8*d* shows said projecting lip can be identified as (PLK). (Note that as shown in FIGS. 4*b*, 5*b* and 6*b*, (PLK) in the case of a mounting clip for use with K-style gutter systems, becomes (PLR) and (PLV) in the cases of mounting clips for use with half-round and vinyl gutter systems, respectively. FIGS. 9*c*, 9*e*, 9*g*, 9*i*, 9*k*, and 9*m* use a K-Style mounting clip as an example and it is to be understood that a similar representation applies to mounting clips meant for use with half-round and vinyl gutter systems (GS)). In the claims the functional purpose of an element is to be understood as covered by the designators which are to be used to represent all analogically similar cases.

Further, where a projecting lip is present in a gutter protection system (CPS) primary body element, and a hem section is present in a mounting clip (MCK) (MCR) (MCV), FIG. 9*a* shows that a designator for said projecting lip is typically (C), (although, again, FIG. 9*b* shows that a projecting lip can be fashioned from lengths of construction material identified as (A) and (C) or any other functionally similar means. Additionally, FIG. 9*c*, for instance, shows that the hem section on a mounting clip is designated by a length of construction material (PLK) which is merged into an oppositely directed projecting length of construction material (PLK'). (Again, as shown in FIGS. 4*b*, 5*b* and 6*b*, (PLK) in the case of a mounting clip for use with K-style gutter systems becomes (PLR) and (PLV) in the case of half-round and vinyl gutter systems (GS), and (PLK') becomes (PLR') and (PLV') in the cases of mounting clips for use with half-round and vinyl gutter systems, respectively). Again, in the claims the designators utilized are to be understood to represent elements which perform a function, and elements which are analogically functionally similar.

It is also to be understood that the terminology "oppositely directed" does not require that two lengths of construction material be oriented so as to project in directions which are at one-hundred-eighty degrees with respect to one another. The criteria as to what constitutes "oppositely directed" as used to describe a hem section is based in the formation of a hem section in which a projecting lip can be functionally positioned, in use.

It is also noted that a relatively recent realization is that the bending of a present invention gutter protection system (GPS) about said relatively gradual bend length of construction material (J) allows easy mounting to gutter systems (GS) which are mounted well below the lower edge of a sloped roof. The step of effecting said identified bend can be a part of a present invention gutter protection system (GPS) installation method.

As a final comment, as described, the present invention works upon the principal of capillary action directed water flow over an upper surface of a gutter protection system (GPS), and it has been found that upper surface treatment(s) can improve said effect.

Having hereby disclosed the subject matter of the present invention, it should be obvious that many modifications, substitutions, and variations thereof are possible in light thereof. It is therefore to be understood that the present invention can be practiced other than as specifically described, and should be limited in breadth and scope only by the claims.

I claim:

1. A gutter protection system (GPS) which in use is affixed between a sloped building roof (ROOF) and a forward upper aspect (FA) of a gutter system (GS), when said gutter system (GS) is affixed to a sloped roof building essentially at a lower edge of, and below, the sloped roof (ROOF) thereof; said gutter protection system (GPS) comprising an element selected from the group consisting of:

a projecting lip (C); and a hem section (HS) comprising, as viewed in right side elevation, a first projecting length of construction material and an oppositely directed projecting length of construction material;

said gutter protection system (GPS) further comprising at least one mounting clip (MCK) (MCR) (MCV) secured at said element selected from the group consisting of:

a projecting lip (C); and a hem section (HS);

said at least one mounting clip (MCK) (MCR) (MCV) comprising an element selected from the group consisting of:

a hem section (HS') comprising, as viewed in right side elevation, a projecting length of construction material and oppositely directed projecting length of construction material; and a projecting lip (PLK) (PLR) (PLV);

said at least one mounting clip (MCK) (MCR) (MCV) serving in use to interface said gutter protection system (GPS) to said forward upper aspect (FA) of said gutter system (GS); said at least one mounting clip being secured to said gutter protection system by causing a hem section (HS') or projecting lip (PLK) (PLR) (PLV) of said at least one mounting clip (MCK) (MCR) (MCV) to functionally mate with a projecting lip (C) or hem section (HS), respectively, of said gutter protection system.

2. A gutter protection system (GPS) as in claim 1, in which said projecting lip present in a member selected from the group consisting of:

said gutter protection system primary body element; and said mounting clip;

can, as viewed from above or in side elevation, be rotated without being removed from said hem section present in a member selected from the group consisting of:

said mounting clip; and said gutter protection system primary body element, respectively;

without said projecting lip being removed from said hem section, said rotations serving to, in combination with positioning along a length of gutter protection system (GPS), allow limited three-dimensional notion of said at least one mounting clip without removal of said projecting lip from said hem section, and thereby facilitate installation of said gutter protection system (GPS) to gutter systems (GS) which are present with non-uniform forward upper aspects (FA).

3. A gutter protection system (GPS) as in claim 1, in which a projecting lip (C) is present on said primary body element of the gutter protection system (GPS) and a mating hem (HS) section is present on said at least one mounting clip (MCK) (MCR) (MCV).

4. A gutter protection system (GPS) as in claim 1, in which a hem section(A) (C) is present on said primary body element of said gutter protection system (GPS) and a mating projecting lip (PLK) (PLR) (PLV) is present on said at least one mounting clip (MCK) (MCR) (MCV).

5. A gutter protection system (GPS) as in claim 4, in which said hem section (A) (C) present on said primary body element of the gutter protection system (CPS) is comprised of a first downward and to the left projecting length of construction material (A) which merges into a first upward and to the right projecting length of construction (C) material by way of an essentially one-hundred-eighty degree bend (B).

6. A gutter protection system as in claim 1, in which a selection from the group consisting of:

said mounting clip (MCK);

hem section (PLK) (PLK'); and said projecting lip (PLK);

includes a gutter interface element comprising, as viewed in right side elevation, an open arcuate section (AS1K) which opens generally to the left, by way of a generally downward projecting length of construction material (DR1K), continuing into an upward and to the right projecting length of construction material into a downward and to the right length of construction material (DR1K'), said gutter interface element serving to facilitate interfacing to the forward upper aspect (FA) of a "K-style" gutter system, and which downward, and to the right projecting length of construction material (DR1K') contacts said gutter system (GS) and serves to facilitate easy installation and removal of said mounting clip (MCK) in use.

7. A gutter protection system as in claim 1, in which a selection from the group consisting of:

said mounting clip (MCR);

hem section (PLR) (PLR'); and said projecting lip (PLR);

includes a gutter interface element comprising, as viewed in right side elevation, an open arcuate shaped section of construction material (AS1R) which opens generally downward, by way of a generally downward projecting length of construction material having an end (DL1R), at said end of said open arcuate shaped section of construction material is present a downward and outward, from an essentially central position within said mounting clip, projecting length of construction material (DO1R), said gutter interface element serving to facilitate interfacing to the forward upper aspect (FA) of a "half-round" gutter system in use, by causing said generally downward opening arcuate shaped length of construction material to spread and slide over said forward upper aspect of a half-round gutter system in use, and said downward and outward projecting length of construction material (DO1R) serving to facilitate removal of said mounting clip (MCR) in use.

8. A gutter protection system as in claim 1, in which a selection from the group consisting of:

said mounting clip (MCV);

hem section (PLV) (PLV'); and said projecting lip (PLV);

includes a gutter interface element comprising (PLV), as viewed in right side elevation, a generally downward projecting length of construction material (DL1V) extending to a common point, from which common point (CP) there are projected a right (RL) and a left leg (LL), said right leg (RL) comprising a downward and to the right projecting length of construction material (DR1V), an arcuate shaped section of construction material (ASLV) which opens generally to the left, continuing into an arcuate shaped section of construction material (ASRV) which opens generally to the right; and said left leg (LL) comprising a downward and to the left projecting length of construction material having an end (DL1V'); at said end of said left leg there being a length of construction material (DO1V) which projects generally downward, and outward, away from an essentially central position within said mounting clip (MCV), said gutter interface element serving to facilitate interfacing to the forward upper aspect (FA) of a "vinyl" gutter system in use by causing said right (RL) and left (LL) legs to spread and slide over a forward upper aspect (PA) of a "vinyl" gutter system in use, and said downward and outward projecting length of construction material (DO1V) serving to facilitate removal of said mounting clip (MCV) in use.

9. A gutter protection system (GPS) as in claim 1, which as viewed in right side elevation prior to being affixed to said sloped roof building essentially at the edge of, and below, the sloped roof (ROOF) thereof, further comprises a downward and to the right projecting length of construction material (E) merging, via a tight bend (D) from a present said projecting lip (C) or said hem section (A) (C), said downward and to the right projecting length of construction material (E) being merged, via a tight bend (P), into an upward and to the right projecting length of construction material (G), said upward and to the right projecting length of construction material (G) being defining openings (GH) which allow water flowing thereonto in use to pass therethrough and enter an underlying gutter system (GS), said upward and to the right projecting length of construction material (G) being merged, via a tight bend (H), into an upward and to the left projecting length of construction material (I) to a length such that a leftmost positioned end thereof is vertically above and left of said tight bend (D), said upward and to the left projecting length of construction material (I) being merged, via a gradual arcuate shaped bend (J), into a left generally horizontal rightwardly projecting length of construction material (K), said left generally horizontal rightward projecting length of construction material (K) being merged, via a gradual bend (L), into an upward and to the right projecting length of construction material (M), said upward and to the right projecting length of construction material (M) being merged, via a gradual arcuate shaped bend (N), into a downward and to the left projecting length of construction material (O), said downward and to the left projecting length of construction material (O) being merged, via a gradual bend (P), into an upward and to the left projecting length of construction material (Q), said upward and to the left projecting length of construction material (Q) being merged, via a gradual arcuate shaped bend (R), into a right generally horizontal rightwardly projecting length of construction material (S), and said right generally horizontal rightwardly projecting length of construction material (S) being, optionally, merged into a horizontally to the left projecting length of construction material (U) via an essentially one-hundred-eighty-degree bend (T).

10. A gutter protection system (GPS) in combination with a gutter system (AS), which gutter protection system (GAS) serves to direct rainwater into an underlying gutter system (GS) to which it is affixed while preventing the entry of debris thereonto, which underlying gutter system (GS) is affixed essentially at a lower edge of a sloping building roof (ROOF), said gutter protection system (GPS) comprising a primary body element in which is present a water flow slowing means (L) (M) (N) (O) (P) (Q) (R) which serves to essentially reverse the flow of rain water at least twice between the entry of said rain onto said gutter protection system, and the flow of said rainwater into said underlying gutter system (GS), which gutter protection system (GPS) utilizes capillary action to direct said rain water flow through said water flow slowing means (L) (M) (N) (O) (P) (Q) (R) during use; said gutter protection system (GPS) further comprising an element selected from the group consisting of:

a projecting lip (C); and a hem section (A)(C) comprising, as viewed in right side elevation, a first projecting length of construction material (A) which is merged into an oppositely directed projecting length of construction material (C);

said gutter protection system (GPS) further comprising at least one mounting clip (MCK) (MCR) (MCV) secured at said gutter protection system (GPS) element selected from the group consisting of:

a projecting lip (C); and a hem section (A) (C);

said at least one mounting clip (MCK) (MCR) (MCV) comprising an element selected from the group consisting of:

a hem section ((PLK)(PLK')) ((PLR) (PLR')) ((PLV) PLV')) comprising, as viewed in right side elevation, a first projecting length of construction material (PLK) (PLR) (PLV) which is merged into an oppositely directed projecting length of construction material (PLK') (PLR') (PLV'); and a projecting lip (PLK) (PLR) (PLV);

said at least one mounting clip (MCK)(MCR)(MCV) serving in use to interface said gutter protection system (GPS) to said forward upper aspect (FA) of said gutter system (GS); said at least one mounting clip (MCK) (MCR) (MCV) being secured to said gutter protection system (GPS) by causing a mating hem section ((PLK) (PLK')) ((PLR)(PLR')) ((PLV) PLV')) or projecting lip (PLK') (PLR') (PLV') of said at least one mounting clip to mate with a projecting lip (C) or hem section (A) (C), respectively, of said gutter protection system (GPS).

11. A gutter protection system (GPS) as in claim 10 in which the water flow slowing means (L) (M) (N) (O) (P) (Q) (R) comprises an "S" shape.

12. A gutter protection system (GPS) as in claim 10 in which the water flow slowing means (L) (M) (N) (O) (P) (Q) (R) comprises an "S" shape with an upper portion thereof collapsed.

13. A gutter protection system (GPS) as in claim 10 in which the water flow slowing means (L) (M) (N) (O) (P) (Q) (R) comprises a "V" shape followed by an inverted "V" shape.

14. A gutter protection system (GPS) which in use is affixed between a sloped building roof (ROOF) and a forward upper aspect (FA) of a gutter systems (GS), when said gutter system (GS) is affixed to a sloped roof building essentially at a lower edge of, and below, the sloped roof (ROOF) thereof; said gutter protection system (GPS) comprising an element selected from the group consisting of:

a projecting lip; and a hem section (HS) comprising a first length of construction material (A) which is merged into a second oppositely directed length of construction material (C);

said gutter protection system (GPS) further comprising at least one mounting clip (MCK) (MCR) (MCV) secured at said hem (A) (C) section or projecting lip, said at least one mounting clip (MCK) (MCR) (MCV) being used in interfacing said gutter protection system (GPS) to upper aspect (FA) of said gutter system (GS); said at least one mounting clip (MCK) (MCR) (MCV) being secured to said hem section (A) (C) or projecting lip (C) of said gutter protection system (GPS) by causing a mating projecting lip (PLK) (PLR) (PLV) or hem section ((PLK) (PLK')) ((PLR) (PLR')) ((PLV) (PLV')), respectively, of said at least one mounting clip (MCK) (MCR) (MCV) to be mated to said hem section (A) (C) or projecting lip (C), respectively, of said gutter said gutter protection system (GPS).

15. A gutter protection system (GPS) as in claim 14, in which a mounting clip (MCK) (MCR) (MCV); hem section ((PLK) (PLK')) ((PLR) (PLR')) ((PLV) (PLV')), or projecting lip (PLK) (PLR) (PLV) is oriented so as to mate with a gutter protection system projecting lip (C) or hem section (A) (C) respectively, and said mounting clip (MCK) (MCR) (MCV) as viewed in right side elevation, is further comprised of a gutter interface element in a shape selected from the group consisting of:

an open arcuate section (AS1K) which opens generally to the left, by way of a generally downward projecting length of construction material (DR1K), continuing into an upward and to the right projecting length of construction material (UR1K) further continuing into a downward and to the right length of construction material (DR1K'), gutter interface element serving to facilitate interfacing to the forward upper (FA) of a "K-style" gutter system, and which downward and to the right length of construction material (DR1K') contacts said gutter system and serves to facilitate easy installation and removal of said mounting clip (MCK) in use;

an open arcuate shaped section of construction material having an end (AS1R) which opens generally downward, by way of a generally downward projecting length of construction material (DL1R), at the end of said open arcuate shaped section of construction material is present a downward and outward, from an essentially central position within said mounting clip, projecting length of construction material (DOIR), said gutter interface element serving to facilitate interfacing to the forward upper aspect (FA) of a "half-round" gutter system in use, by causing said generally downward opening arcuate shaped length of construction material to spread and slide over said forward upper aspect (FA) of a half-round gutter system in use, and said downward and outward projecting length of construction material (DOIR) serving to facilitate removal of said mounting clip (MCR) in use;

a generally downward projecting length of construction sate (DL1V), extending to a common point (CP), from which common point (CP) there are projected a right (RL) and a left leg (LL), said right leg (RL) comprising a downward and to the right projecting length of construction material (DR1V), an arcuate shaped section of construction material (ASLV) which opens generally to the left, an arcuate shaped section of construction material (ASRV) which opens generally to the right; and said left leg (LL) comprising a downward and to the left projecting length of construction material having an end (DL1V'); at said end of said left leg there being a length of construction material (DO1V) which projects generally downward, and outward, away from an essentially central location in said mounting clip (MCV), said gutter interface element serving to facilitate interfacing to the forward upper aspect (FA) of a "vinyl" gutter system in use by causing said right (RL) and left (LL) legs to spread and slide over a forward upper aspect (FA) of a "vinyl" gutter system in use, and said downward and outward projecting length of construction material (DOIV) serving to facilitate removal of said mounting clip (MCV) in use;

such that said projecting lip present in a member selected from the group consisting of:

said gutter protection system primary body element; and said mounting clip;

can, as viewed from above or in side elevation, be rotated without being removed from said hem section present in a member selected from the group consisting of:

said mounting clip; and said gutter protection system primary body element, respectively;

said rotations serving to, in combination with positioning along a length of gutter protection system (GPS), allow limited three-dimensional motion of said at least one mounting clip without removal of said projecting lip from said hem section, and thereby facilitate installation of said gutter protection system to gutter systems which present with non-uniform forward upper aspects (FA).

16. A gutter protection system (GPS) which in use is affixed between a sloped building roof (ROOF) and a forward upper aspect (FA) of a gutter system (GS), when said gutter system (GS) is affixed to a sloped roof building essentially at a lower edge of, and below, the sloped roof (ROOF) thereof; said gutter protection system (GPS) comprising, as viewed in right side elevation, a first projecting length of construction material (A) which is merged into an oppositely directed projecting length of construction material (C), said gutter protection system (GPS) further comprising at least one mounting clip (MCK) (MCR) (MCV), said at least one mounting clip (MCK) (MCR) (MCV) comprising a projecting lip length of construction material (PLK) (PLR) (PLV), said at least one mounting clip (MCK) (MCR) (MCV) serving in use to interface said gutter protection system (GPS) to said forward upper aspect (FA) of said gutter system (GS); said at least one mounting clip being secured to said gutter protection system by causing a projecting lip (PLK) (PLR) (PLV) of said at least one mounting clip (MCK) (MCR) (MCV) to functionally mate with a hem section (HS) of said gutter protection system.

17. A gutter protection system (GPS) as in claim 16, in which said hem section length of construction material (A) projects downward and to the left and in which said length of construction material (C) projects upward and to the right as does said at least one mating mounting clip (MCK) (MCR) (MCV) projecting lip (PLK) (PLR) (PLV).

18. A gutter protection system (GPS) which serves to direct rainwater into an underlying gutter system (GS) to which it is affixed while preventing the entry of debris thereonto, which underlying gutter system (GS) is affixed to a wall (WALL) essentially at a lower edge of a sloping building roof (ROOF), said gutter protection system (CGPS) comprising a primary body element in which is present a water flow slowing means comprising lengths of construction material (L) (M) (N) (O) (P) (Q) (R) and roof (ROOF) contacting length of construction material (S), and which generally forms an "S" shape which serves to essentially reverse the flow of rain water entering via capillary action over an upper surface of said roof (ROOF) contacting length of construction material (S) at least twice between the entry of said rain onto said gutter protection system, and the flow of said rainwater into said underlying gutter system (GS), which gutter protection system (GPS) utilizes capillary action to direct said rain water flow through said water flow slowing means (L) (M) (N) (O) (P) (Q) (R) (S) during use; said gutter protection system (GPS) further comprising an element selected from the group consisting of:

a projecting lip (C); and a hem section (A) (C) comprising, as viewed in right side elevation, a first projecting length of construction material (A) which is merged into an oppositely directed projecting length of construction material (C), said gutter protection system (GPS) further comprising at least one mounting clip (MCK) (MCR) (MCV) secured at said gutter protection system (GPS) element selected from the group consisting of:

a projecting lip (C); and a hem section (A) (C);

said at least one mounting clip (MCX) (MCR) (MCV) comprising an element selected from the group consisting of:

a hem section ((PLK) (PLK')) ((PLR) (PLR'))((PLV) (PLV')), comprising, as viewed in right side elevation, a first projecting length of construction material (PLK) (PLR) (PLV) which is merged into an oppositely directed projecting length of construction material (PLK') (PLR') (PLV'); and a projecting lip (PLK) (PLR) (PLV));

said at least one mounting clip (MCK) (MCR) (MCV) serving in use to interface said gutter protection system (GPS) to a forward upper aspect (FA) of said gutter system (GS) in use; said at least one mounting clip (MCK) (MCR) (MCV) being secured to said gutter protection system (GPS) by causing said mating hem section ((PLK) (PLK')) ((PLR) (PLR')) ((PLV)(PLV')) or projecting lip (PLK') (PLR') (PLV) of said at least one mounting clip to mate with a projecting lip (C) or hem section (A) (C), respectively, of said gutter protection system (GPS); wherein said gutter protection system (GPS) is secured to said sloped roof building by means of a mounting bracket (MB), which comprises a first downward projecting length(MB1) of bracket material which is merged via intervening lengths of bracket material into generally to the left projecting length (MB) of bracket material; said generally to the left projecting length of bracket material (MB), in use, being projected as a projecting lip into a hem section formed between gutter protection system downward and to the left projecting length of construction material (O) and the right generally horizontal rightwardly projecting length of construction material (S), while the first downward projecting length (MB1) of bracket material is secured to said wall (WALL).

19. A gutter protection system (GPS) which in use is affixed between a sloped building roof and a forward upper aspect (FA) of a gutter system (GS), which gutter system (GS) is affixed to a sloped roof building essentially at a lower edge of, and below, the sloped roof (ROOF) thereof; said gutter protection system (GPS), as viewed in right side elevation, prior to affixing to a sloped roof building, comprises an element selected from the group consisting of:

a hem "group" section (A) (C), said hem section comprising a first downward and to the left projecting length of construction material (A) which is merged into a first upward and to the right projecting length of construction material (C), and;

a projecting lip (C);

said first element (C) merging, via a relatively tight bend (D), into a downward and to the right projecting length of construction material (E), said downward and to the right projecting length of construction material (E) being merged, via a relatively tight bend (F), into an upward and to the right projecting length of construction material (G), said upward and to the right projecting length of construction material (G) defining openings (GH) which allow water flowing thereonto in use to pass therethrough and enter an underlying gutter system (GS), and being merged, via a relatively tight bend (H), into an upward and to the left projecting length of construction material (I) to a length such that a leftmost positioned end thereof is vertically above said first upward and to the right projecting length of construction material (C), said upward and to the left projecting length of construction material (I) being merged, via a relatively gradual bend (J), into a left generally horizontal rightwardly projecting length of construction material (K), said left generally horizontal rightwardly projecting length of construction material (K) being merged, via a relatively gradual bend (L), into an upward and to the right projecting length of construction material (M), said upward and to the right projecting length of construction material (M) being merged, via a relatively gradual bend (N), into a downward and to the left projecting length of construction material (O), said downward and to the left projecting length of construction material (O) being merged, via a relatively gradual bend (P), into an upward and to the left projecting length of construction material (Q), said upward and to the left projecting length of construction material (Q) being merged, via a relatively gradual shaped bend (R), into a right generally horizontal rightwardly projecting length of construction material (S), and said right generally horizontal rightwardly projecting length of construction material (S) being merged, optionally, into a horizontally to the left projecting length of construction material (U) via an essentially one-hundred-eighty-degree bend (T).

20. A gutter protection system (GPS) as in claim 19 in which a hem section is present and in which said first downward and to the left projecting length of construction material (A) is approximately (0.383) inches long and is merged into a first upward the right projecting length of construction material (C) by way of an essentially one-hundred-eighty degree bend (B) involving construction material of approximately 0.093 inches long, said first upward and to the right projecting length of construction (C) being approximately 0.383 inches long and is merged, via a relatively tight bend involving construction material (D) of approximately 0.039 inches long, into a downward and to the right projecting length of construction material (E) of approximately 0.544 inches long, said downward and to the right projecting length of construction material (E) being merged, via a relatively tight bend (F) involving construction material of approximately 0.086 inches long, into an upward and to the right projecting length of construction material (G) of approximately 0.231 inches long, said upward and to the right projecting length of construction material (G) being comprised of openings (GH) which allow water flowing thereonto in use to pass therethrough and enter an underlying gutter system (GS), and being merged, via a relatively tight bend (H) involving construction material of approximately 0.085 inches long, into an upward and to the left projecting length of construction material (I) of approximately 0.841 inches long, said length providing that a leftmost positioned end thereof is vertically above said first upward and to the right projecting length of construction material (C), said upward and to the left projecting length of construction material (I) being merged, via a relatively gradual bend (J) involving construction material of approximately 0.25 inches long, into a left generally horizontal rightwardly projecting length of construction material (K) of approximately 3.435 inches long, said left generally horizontal rightwardly projecting length of construction material (K) being merged, via a relatively gradual bend (L) involving construction material of approximately 0.014 inches long, into an upward and to the right projecting length of construction material (M) of approximately 0.271 inches long, said upward and to the right projecting length of construction material (M) being merged, via a relatively gradual bend (N) involving construction material of approximately 0.183 inches long, into a downward and to the left projecting length of construction material (O) of approximately 0.245 inches long, said downward and to the left projecting length of construction material (O) being merged, via a relatively gradual bend (P) involving construction material of approximately 0.019 inches long, into an upward and to the left projecting length of construction material (Q) of approximately 0.125 inches long, said upward and to the left projecting length of construction material (Q) being merged, via a relatively gradual shaped bend (R) involving construction material of approximately 0.139 inches long, into a generally horizontal rightwardly projecting length of construction material (S) of approximately 3.689 inches long, and said right generally horizontal rightwardly projecting length of construction material (S) being merged into a horizontally to the left projecting length of material (U) of approximately 0.220 inches long via an essentially one-hundred-eighty degree bend (T) involving construction material of approximately 0.104 inches long.

21. A method of affixing a gutter protection system (GPS) to a sloped roof building comprising the steps of:

providing a gutter protection system (GPS) which in use is affixed between a sloped building roof and a forward upper aspect (FA) of a gutter system (GS), which gutter system (G) is affixed to a sloped roof building essentially at a lower edge of, and below, the sloped roof (ROOF) thereof adjacent to a wall (WALL) of said sloped roof building; said gutter protection system (GPS) as viewed in right gutter elevation, prior to affixing to a sloped roof building, comprising an element selected from the group consisting of:

a hem section (HS), said hem group section comprising a first projecting length of construction material (A)

which is merged into an oppositely directed projecting length of construction material (C); and a projecting lip (C);

said oppositely directed projecting length of construction material or projecting lip (C) merging, via a relatively tight bend (D), into a downward and to the right projecting length of construction material (E), said downward and to the right projecting length of construction material (E) being merged, via a relatively tight bend (F), into an upward and to the right projecting length of construction material (G), said upward and to the right projecting length of construction material (G) being comprised of openings (GH) which allow water flowing thereonto in use to pass therethrough and enter an underlying gutter system (GS), and being merged, via a relatively tight bend (H), into an upward and to the left projecting length of construction material (I) to a length such that a leftmost positioned end thereof is vertically above and left of said tight bend (D), said upward and to the left projecting length of construction material (I) being merged, via a relatively gradual bend (J), into a left generally horizontal rightwardly projecting length of construction material (K), said left generally horizontal rightwardly projecting length of construction material (K) being merged, via a relatively gradual bend (L), into an upward and to the right projecting length of construction material (M), said upward and to the right projecting length of construction material (M) being merged, via a relatively gradual bend (N), into a downward and to the left projecting length of construction material (O), said downward and to the left projecting length of construction material (O) being merged, via a relatively gradual bend (P), into an upward and to the left projecting length of construction material (Q), said upward and to the left projecting length of construction material (Q) being merged, via a relatively gradual shaped bend (R), into a right generally horizontal rightwardly projecting length of construction material (S), and said right generally horizontal rightwardly projecting length of construction material (S) being merged, optionally, into a horizontally to the left projecting length of construction material (U) via an essentially one-hundred-eighty degree bend (T);

securing at least one mounting clip (MCK) (MCR) (MCV) presenting with an element selected from the group consisting of:

a hem section (HS), said hem section comprising a first projecting length of construction material (PLK) (PLR) (PLV) which is merged into an oppositely directed projecting length of construction material (PLK') (PLR') (PLV'); and a projecting lip (PLK) (PLR) (PLV);

to said gutter protection system (GPS), by causing said hem section or projecting lip to mate with a projecting lip or hem section, respectively, on a gutter protection system (GPS);

causing said left generally horizontally rightwardly projecting length of construction material (K) to assume an angle with respect to said major right horizontally to the right projecting length of construction material (S) by a bending about intervening gutter protection system elements (L) (M) (N) (O) (P) (Q) (R), said angle being selected to match the slope of said sloped building roof (ROOF), and effecting a desired degree of relatively gradual bend (J); and simultaneously causing said at least one mounting clip (MCK) (MCR) (MCV) to interface to a forward upper aspect (FAX of a gutter system (GS) which is affixed to said building essentially at the edge of, and below, said sloped roof (ROOF), and said generally right generally horizontal rightwardly projecting length of construction material (S) to be present at a lower extent of said sloped roof (ROOF) such that at least one of the following conditions is met:

said right generally horizontal rightwardly projecting length of construction material (S) is projected under a row of shingles;

said right generally horizontal rightwardly projecting length of construction material (S) is caused to be present atop of shingles; or said gutter protection system (GAS) is secured to said sloped roof building by means of a mounting bracket (MB) which comprises a first downward projecting length (MB1) of bracket material which is merged into a first upward projecting length (MB3) of bracket material by an essentially one-hundred-eighty degree bend (MB2), said first upward projecting length (MB3) of bracket material being merged into a generally to the left projecting length (MB4) of bracket material, which merges into a generally upward to the right projecting length (MB6) of bracket material via a generally arcuate shaped length (MB5) of bracket material said generally upward to the right projecting length (MB6) of bracket material being merged into a generally to the left projecting length (MB8) of bracket material via a generally arcuate shaped length (MB7) of bracket material; said generally to the left projecting length of bracket material, in use, being projected as a projecting lip into a "hem" section formed between present invention gutter protection system downward and to the left projecting length of construction material (O) and the right generally horizontal rightwardly projecting length of construction material (S), while the first downward projecting length (MB1) of bracket material, which is merged into a first upward projecting length (MB3) of bracket material by an essentially one-hundred-eighty degree bend (MB2), is secured to a wall (WALL) of a sloped roof (ROOF) building, typically by one or more screws.

* * * * *